United States Patent [19]

Chasman

[11] Patent Number: 4,662,155

[45] Date of Patent: May 5, 1987

[54] METHOD AND APPARATUS FOR FORMING CAPSULES

[76] Inventor: Sydney A. Chasman, 1350 Outlook Dr., Mountainside, N.J. 07092

[21] Appl. No.: 798,103

[22] Filed: Nov. 14, 1985

Related U.S. Application Data

[60] Division of Ser. No. 539,550, Oct. 6, 1983, Pat. No. 4,567,714, which is a continuation-in-part of Ser. No. 210,132, Nov. 24, 1980, abandoned.

[51] Int. Cl.[4] ..... B65B 31/04

[52] U.S. Cl. ..... 53/433; 53/511

[58] Field of Search ..... 53/433, 454, 511, 560

[56] References Cited

U.S. PATENT DOCUMENTS

| | | | |
|---|---|---|---|
| 2,431,141 | 11/1947 | Scherer | 53/560 |
| 2,840,961 | 7/1958 | Karpowicz | 53/511 |
| 3,245,197 | 4/1966 | Van Mil | 53/560 |
| 3,269,088 | 8/1966 | Kath | 53/560 |
| 3,557,517 | 1/1971 | Limmer | 53/511 |
| 3,626,655 | 12/1971 | Eltel | 53/511 X |
| 4,162,599 | 7/1979 | Kyle | 53/511 X |
| 4,366,663 | 1/1983 | Grebe | 53/560 X |

*Primary Examiner*—John Sipos

*Attorney, Agent, or Firm*—Lerner, David, Littenberg, Krumholz & Mentlik

[57] ABSTRACT

A method and apparatus for forming capsules having a fill material which might be adversely affected by the presence of air. A capsule forming material, which forms a portion of the casing of the capsules, is fed along a predetermined path of movement past a sealing station for sealing of the cavities. A fill material is deposited in the cavities of the capsule forming material prior to cavities being sealed at the sealing station. An evacuation member having an evacuation surface is disposed to face the cavities in the capsule forming material and seal against the capsule forming material as the capsule forming material is moved past the evacuation member to form a substantially airtight seal between the evacuation member and the capsule forming material. The evacuation member includes first and second flow communication conduits communicating with the evacuation surface, the first flow communication conduit communicating with a source of vacuum for withdrawing air from between the surface of the capsule forming material and the evacuation surface and the second flow communication conduit communicating with a source of inert gas for introducing inert gas between the surface of the capsule forming material and the evacuation surface. The first and second flow communication conduits communicate with the evacuation surface at spaced-apart locations so as to provide a continuous sweeping of air from the cavities and replacement thereof with an inert gas.

16 Claims, 21 Drawing Figures

METHOD AND APPARATUS FOR FORMING CAPSULES

This is a division of application Ser. No. 539,550, filed Oct. 6, 1983 now U.S. Pat. No. 4,567,714 which is a continuation-in-part of appln. Ser. No. 210,132, filed Nov. 24, 1980, now abandoned.

FIELD OF THE INVENTION

The present invention relates generally to a method and apparatus for forming capsules containing a measured amount of solid and/or liquid fill material, and more particularly to a method and apparatus for forming capsules from webs or sheets of capsule forming material, such as gelatin, as well as to various features of such method and apparatus, including an apparatus for forming webs for use in such capsule making method and apparatus. The method and apparatus of the present invention are particularly useful in connection with forming of completely sealed capsules containing a pharmaceutical product, such as for example medicines, vitamins, food supplements and the like.

BACKGROUND OF THE INVENTION

Many products are encapsulated for convenience in distribution and use. Among these are medicinal compounds, such as drugs or vitamins, which are commonly encased in gelatin capsules. Capsules are also used when small, accurately determined quantities of material are to be used in compounding other products, such as for example, small capsules of food coloring for combining with artificial food products to produce a desired color. Such capsules may be filled with either a powdered material or a liquid, or even possibly a combination of such materials.

While a number of prior art arrangements are known for the manufacture and production of gelatin capsules either for powdered material or a liquid, such prior art arrangements generally are not readily adaptable for filling of capsules with both powdered material and a liquid. Rather, such prior art arrangements are generally only directed to the utilization of a fill powder or a fill liquid.

For instance, U.S. Pat. No. 3,092,942 entitled "Apparatus for Encapsulating" to Chasman is directed to a machine and method for making fluid filled capsules from continuous sheets of plastic film. However, the machine disclosed in this patent is not readily adapted to filling the capsules with a dry fill powder. On the other hand, U.S. Pat. No. 2,775,084 is directed to an apparatus for filling capsules with a powder material. Again, however, such apparatus is not readily adaptable for filling the capsules with a fluid or liquid.

Generally, in many of the prior art capsule forming apparatus and methods, a pair of plastic webs, for example webs of gelatin material, are fed about a pair of sealing rolls having a series of depressions or recesses formed in the surface thereof. The recesses in each sealing roll may be connected to a suitable source of vacuum for applying a suction to the web when it is laid onto the surface to thereby form a series of cavities or pockets in the surface of the web. The depressions or recesses in the sealing rolls are arranged with respect to one another and the sealing rolls driven in unison and synchronized with one another so that as the sealing rolls are rotated in opposite directions, the depressions on one sealing roll register with the depressions on the other sealing roll in the nip of the two rolls. Thus, as the webs are directed toward the nip of the sealing rolls, the pockets or cavities formed in the web traveling on one roll are brought into juxtaposition with the pockets or cavities formed in the other web. That as, as the webs progress through the nip, the portions of the respective webs surrounding each depression are pinched together to essentially create a seal about the pair of juxtaposed pockets or cavities and thereby form a completed capsule. Generally, either a liquid or dry powder material is deposited into one or both of the cavities of the respective webs just prior to the two webs being brought into juxtaposition and sealingly closed.

While a number of of such apparatus of this general nature are known, a number of problems have existed with such prior art apparatus, both with respect to the dry fill type apparatus and the liquid fill type apparatus. For example, one significant problem associated with conventional powdered fill capsule forming apparatus has been the sealing of the capsule halves together with the pharmaceutical product therein. In particular, prior art powder filled capsules have had a tendency, after drying of the gelatin casing, to break open along the sealed seam and thereby spill the contents thereof. Such problems in sealing of the capsule halves has been due, at least in part, to the fact that dust or other powdered materials have spilled or been deposited on the web of the fresh gelatin material about the cavity or pocket formed therein during the fill operation. Such spillage in turn presents a tight, effective and sound seal from being formed when the web of the material passes between the nip of the sealing rolls.

A further problem associated with conventional powdered fill capsule forming apparatus has been the precise control of the amount of material deposited into the capsule, both from the standpoint of initial measurement of the amounts as well as from the standpoint of spillage or loss of such material in depositing the fill material into the capsules halves. For instance, in the apparatus shown in British Patent Specification No. 881,022, entitled "Improvements Relating to Methods and Machines for Forming and Filling Capsules in Gelating or the Like", there is disclosed an apparatus of the general type described above in which capsule halves are formed from gelatin webs and then brought into juxtaposition and sealed after the placement of a dry fill powder in each cavity half. In this apparatus, there is provided a medicament supply hopper containing a supply of fill powder above each of the sealing rolls. A rotary feed roll is disposed between each supply hopper and its respective sealing roll for receiving a supply of powder from the hopper and depositing same in the capsule halves. The feed roll has at its periphery axial and circumferential rows of chambers which are spaced so as to coincide with the spacing of the cavities on its respective sealing roll. The chambers each include a spring loaded plunger or ejector therewithin which is normally in a retracted position. As the feed roll rotates, the chambers which are in alignment with the hopper are supplied with powder or granules of material to be encapsulated. The size of the chamber is designed so that it will receive a desired quantity of material. The filled chambers are then rotated within a stationary annular housing which serves to maintain the charge of powder material within the chamber. An opening is provided at the bottom of the annular housing through which the powder material in the chamber is deposited into a cavity on the sealing roll when the chamber moves into alignment therewith. A cam member is provided for forcing the plunger outwardly against the spring to ensure that the fill material is ejected from the chamber and into the cavity formed in the web on the sealing roll. As can be appreciated, with such an arrangement, it is most difficult to change or adjust the amount of fill material which is received within each chamber, and further there is a possibility that the chamber will not be completely filled, or that powder or fill material will be lost during the transfer from the feed roll into the cavity since the fill material is only loosely received in the chambers.

Additionally, as is known in the art, some types of fill materials, especially certain types of liquid, such as vitamins, when exposed to air over a period of time, deteriorate and may become rancid. As can be appreciated, since the cavity halves in each web are open and exposed to the surrounding atmosphere during the filling operation, it has not been possible heretofore to produce capsules having such fill materials with conventional capsule forming apparatus of the type disclosed unless the entire capsule forming apparatus is operated in an inert atmosphere.

Still further, with some prior art capsule forming apparatus, the gelatin web is formed by depositing molten gelatin onto a rotating casting drum which is at a somewhat cooler temperature to solidify the gelatin and form a web which is then continuously pulled off of the drum. With such prior art arrangements, the gelatin supply box rests directly on the gel forming surface of the casting drum and molten gelatin flows onto the drum as it is rotated, the thickness of the layer of gelatin being controlled by a "doctor" blade arranged at the forward end of the gelatin supply box. Generally, the doctor blade is carried by the gelatin supply box, and its position above the surface of the casting drum, which defines the thickness of the formed gelatin web, is adjustable. Since the gelatin supply box rides on the surface of the casting drum, should a film or very thin layer of gelatin remain on the casting drum during operation, the thickness of the formed gelatin web may not be precisely accurate. Furthermore, as the adjustment mechanism for adjusting the position of the doctor blade is on the gelatin supply box itself, there is a possibility of damage, breakage, etc., when the gelatin supply box is cleaned between operations.

Accordingly, in view of the above and other disadvantages, a need exists for improved methods and apparatus for forming capsules, as well as for forming webs for use in capsule manufacture.

SUMMARY OF THE INVENTION

In accordance with one aspect of the present invention, there is provided an apparatus for forming a sealed capsule containing a powdered pharmaceutical material therein, the apparatus including feeding means for feeding a capsule forming material having a cavity formed therein along a predetermined path, the capsule forming material forming a portion of the casing of the formed capsule, powder supply means containing a supply of powdered pharmaceutical material, and a cylindrical punch roll having a radially extending chamber therein for receiving a predetermined charge of powdered material from the supply means. The powder supply means and the cylindrical punch roll are spacedly positioned from the path along which the capsule forming material is fed. Compacting means are associated with the cylindrical punch roll for compacting the predetermined charge of powdered material in the chamber in order to form a compacted slug. In addition, a cylindrical transfer roll is provided for transferring the compacted slug from the chamber in the punch roll to the cavity in the capsule forming material. The transfer roll includes a recess in the cylindrical surface thereof, and is positioned intermediate the cylindrical punch roll and the predetermined path along which the capsule forming material is fed. The transfer roll is operatively rotatable to align the recess therein with the chamber in the punch roll as the punch roll is rotated to receive the compacted slug from the chamber, and then operatively rotatable to deposit the compacted slug in the recess in the transfer roll into the cavity of the capsule forming material. Means are also provided for collecting free and uncompacted powdered material transferred with the compacted slug to the transfer roll to thereby minimize the depositing of free excess powdered material onto the capsule forming material. Finally, sealing means are provided for sealing the cavity in the capsule forming material after it has received the compacted slug. In accordance with the preferred embodiment, the means for collecting free and uncompacted powdered material comprises vacuum means for communicating with the recess in the cylindrical surface of the transfer roll to apply a reduced pressure to the recess during a portion of the rotation of the transfer roll.

It will be appreciated that the apparatus in accordance with this aspect of the present invention serves to minimize the problem of spillage or dust collecting on the capsule forming material such that tight sound seals will be produced by the sealing means. More particularly, this is achieved in part as a result of the powder supply means being positioned remotely from the path along which the capsule forming material is fed. In addition, the powdered material is initially compacted in the punch roll to form a compacted slug. Thus, the possibility of free, excess dust or powdered material being deposited or finding its way onto the capsule forming material is minimized since only a compacted slug will be deposited into the cavity in the capsule forming material and since the compacting operation takes place remotely from the capsule forming material. Furthermore, the depositing of the compacted slug into the cavity in the capsule forming material is accomplished with a transfer roll which also aids in minimizing the possibility of dust or powdered material collecting on the web of capsule forming material. Still further, means are provided associated with the transfer roll for collecting free and uncompacted powdered material transferred with the compacted slug so that a virtually clean, powder-free compacted slug is deposited into the cavity of the capsule forming material after the transfer roll has been rotated into position to be in alignment with the cavity in the capsule forming material.

In accordance with a further preferred embodiment, adjusting means are provided for adjusting the position of the punch member in the chamber of the punch roll as the punch roll rotates past the supply means so that the amount of material received within the chamber corresponds to the predetermined charge of powdered material, the adjusting means being adjustable to vary as desired the predetermined charge of material received within the chamber. In this manner, precise control of the amount of pharmaceutical material provided in the formed capsule may be simply adjusted. Additionally, with this arrangement, it is possible to use the same apparatus to form capsules having different amounts of powdered material therein without the necessity of completely disassembling the punch roll and punch member arrangement.

According to a still further aspect of the present invention, there is provided a method and apparatus for forming capsules having fill material which might be adversely affected by the presence of air. The apparatus comprises feeding means for feeding a capsule forming material having a series of cavities formed therein along a predetermined path, the capsule forming material forming a portion of the casing of the capsule, and the feeding means also including sealing means for sealing the cavity after the cavity has been filled with a fill material. Depositing means serve to deposit a fill material in the cavities of the capsule forming material prior to the cavities being sealed by the sealing means. Air displacing means are provided for displacing air in the cavity and substituting therefor an inert gas prior to the cavity being sealed by the sealing means so that substantially deaerated capsules are formed. This is most advantageous with respect to fill materials which may be adversely affected by the presence of air, such as for example liquids which become rancid in the presence of air.

Still further, according to another aspect of the present invention, there is provided an apparatus for forming a web of predetermined thickness from a molten material. The apparatus comprises a rotatable cylindrical drum having a cylindrical gel forming surface thereon, and first and second cylindrical support surfaces thereon, the first and second cylindrical support surfaces being spacedly positioned along the axis of rotation of the drum on opposite sides of the gel forming surface and being concentric with the cylindrical gel forming surface. Support means are provided for riding on the first and second cylindrical support surfaces as the drum rotates, and molten material supply means are provided for depositing the molten material onto the rotatable cylindrical drum as the drum is rotated. Blade means carried by the support means and spaced from the gel forming surface on the drum are provided for spreading deposited molten material to form a continuous layer of material on the gel forming surface of the drum as the drum rotates therepast, the spacing of the blade means from the gel forming surface controlling the thickness of the continuous layer of material formed thereon. Also, adjustment means are provided for adjusting the position of the blade means relative to the support means to control the spacing of the blade means from the gel forming surface of the drum to correspond to the predetermined thickness of the web. In this regard, one of the key features of this aspect of the invention is the provision of the blade means being carried by the support means which is supported on surfaces spaced from the gel forming surface. In this manner, the means carrying the blade is not subject to inaccuracies in dimensions, such as due to impurities, films, etc., which may exist on the gel forming surface. Furthermore, the molten material supply means, which necessarily must be cleaned after any batch operation, may be maintained separate and independent of the mechanism for controlling the positioning of the blade means relative to the surface of the drum, thereby minimizing the possibility of damage, breakage, etc., of such adjustment mechanism during a cleaning operation.

These and further features and characteristics of the present invention will be apparent from the following detailed description in which reference is made to the enclosed drawings which illustrate the preferred embodiment of the present invention.

DETAILED DESCRIPION OF THE PREFERRED EMBODIMENT

Figure 1:
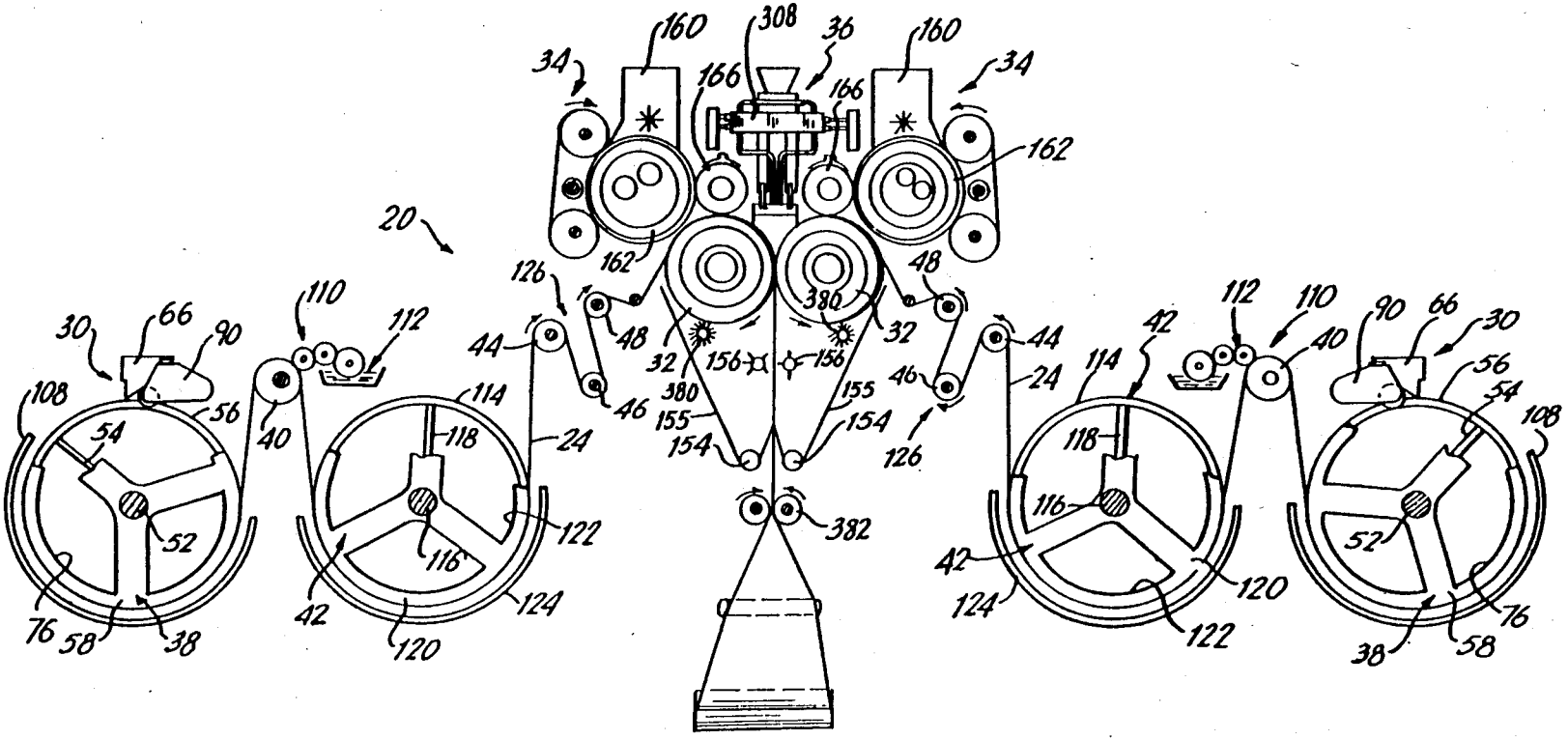
FIG. 1 is a schematic and elevational view of the apparatus in accordance with the present invention.

Referring now to the drawings wherein like reference characters represent like elements, there is shown in FIG. 1 a schematic end elevational view of the apparatus 20 in accordance with the present invention for manufacturing capsules 22 from a pair of sheets of plastic material 24, such as gelatin. The capsules 22 manufactured with the apparatus 20 of the present invention are completely closed and sealed, and are made from webs 24 having pockets 26 formed therein with a pharmaceutical fill material deposited in the pockets 26, a pair of such webs 24 being brought together so that the pockets 26 are juxtaposed to one another and sealed about their periphery. The fill material, for example, may comprise a medicine or other type of drug, vitamin, food supplement or the like. The provision of completely sealed pharmaceutical capsules 22 such as made with the present invention offer significant advantages in terms of safety and in particular, in preventing or minimizing tampering with the contents thereof after production. Such pharmaceutical capsules 22 manufactured in this manner are to be contrasted with capsules which are comprised of a pair of open ended capsule halves which are assembled one within the other. The apparatus 20 of the present invention may be used for the manufacture of capsules 22 filled with either a dry fill powder, or a liquid fill material, or a combination of both powder and liquid if desired.

The basic apparatus 20 in accordance with the present invention includes a pair of web casting apparatus 30 for producing a pair of continuous webs or sheets 24 of plastic material, such as webs 24 of soft gelatin, a pair of sealing rolls 32 for forming capsule pockets 26 in the webs 24 and then sealing same after they have been filled with fill material, and filling apparatus 34, 36 for filling the capsule pockets 26 formed in the webs 24 with either a dry fill powder, a liquid fill material or a combination of dry and liquid fill materials. The web casting apparatus 30 includes a pair of web casting drums 38 and a series of rolls or drums 40, 42, 44, 46, 48 about which the cast webs 24 are passed to properly condition and treat the webs 24 before being trained about the sealing rolls 32. The pair of sealing rolls 32 are arranged in nipping relationship to one another and are adapted to rotate in opposite directions so as to feed the pair of webs or continuous sheets 24 between the nip formed therebetween. Each of the sealing rolls 32 is provided with a plurality of recesses or depressions 50 arranged on its entire outer surface, and the pair of sealing rolls 32 are driven in unison and synchronized such that the depressions 50 in one roll 32 register with those in the other roll 32 at the nip. As the sheets or webs 24 of gel material are trained about the sealing rolls 32, the sheet material 24 is forced into the depressions 50 in the sealing rolls 32 to form the pockets or cavities 26 in each of the webs 24. As the sheets or webs 24 progress toward the nip of the sealing rolls 32, material to be capsulated is deposited in each of the pockets or cavities 26 by means of appropriate filling apparatus 34, 36, to be described in more detail hereinbelow. The filled pockets 26 are then carried toward the nip between the sealing rolls 32. As the webs 24 pass through the nip, respective pockets 26 in each of the webs 24 are brought into juxtaposition with one another and sealed about the circumference thereof to form a completely enclosed capsule 22 having the fill material contained therewithin. That is, at the nip of the sealing rolls 32, the sealing rolls 32 serve to bring the two webs 24 into contact and to seal the webs 24 about the periphery of the formed pockets 26. Thereafter, as the formed capsules 22 are removed or separated from the pair of webs 24, they are collected, washed and directed to a suitable drying and quality control areas, as is known in the art.

The key aspects or areas with which the present invention is concerned include the formation of the webs 24, and the filling of the cavities 26 formed in the webs 24 with suitable fill material, including both dry fill powder and liquid fill material. Additionally, there are various other features of the apparatus 20 and method in accordance with the present invention which provide for a more rapid and efficient manufacture of capsules 22.

Turning now to a more detailed description of the apparatus 20 in accordance with the present invention, the web forming or casting apparatus 30 will be discussed first. As can be seen in FIG. 1, the pair of web casting apparatus 30 for forming the pair of webs 24 from capsule forming material are identical to one another. Accordingly, only one of such apparatus 30 will be described hereinbelow, it being understood that the apparatus 30 for and manner of producing the other web 24 is essentially the same.

As shown best in FIGS. 1–4, each web casting drum 38 includes a central axially extending shaft 52 which has a plurality of radially extending arms 54 supported thereon which are connected at their outer extremities to the inner surface of a cylindrical casting member 56 for supporting the casting member for rotation about the axis of the shaft 52. The outer cylindrical surface of the casting member 56 defines the casting surface on which a layer of molten plastic material is to be cast to form a continuous web 24 of capsule forming material. At the opposite axial ends of the casting member 56 there is provided a pair of support rings 58. The support rings 58 are mounted on the shaft 52 and have an inner shoulder 60 thereon on which a lip 62 of the casting member 56 rests and an outer cylindrical surface 64 which is spaced radially inwardly of the outer surface of the casting member 56 (see FIG. 3). The casting drum 38 is suitably supported from the main frame or base of the apparatus 20 and is driven in suitable time relationship with the rest of the apparatus 20 by suitable mechanical drive mechanisms which may be of a conventional nature.

A molten material supply hopper or box 66 is arranged on top of the casting drum 38 for depositing a layer of capsule forming material onto the surface of the casting member 56 to thereby cast a continuous web 24 of capsule forming material. The capsule forming material may for example comprise a gelatin material which is generally acceptable for capsules to be taken internally. The specific gelatin material to be used may vary depending upon the types of materials to be encapsulated, as well as its conditions of use. Generally, such gelatin materials are characterized by their strength, which corresponds to the weight the gelatin material will support at a given temperature, and the amount of water and other plasticizers or materials that may be used in forming the gelatin material. For example, one typical type of gel comprises a "150" gel strength gelatin which for example may comprise a mixture of 40% of commercial gelatin with the remaining constituents comprising glycerine (as plasticizer) and water, together with flavoring and coloring material as may be desired. Of course, for capsules for other uses, such as marketing chemicals for specific applications, other types of plastic materials may be utilized. These other materials being selected according to the material to be encapsulated and its conditions of use, as is well known in the art.

The molten gelatin, or other capsule forming material, is initially prepared and then fed into the gelatin supply hopper 66 from a suitable source of supply which serves to maintain a reasonably uniform level of molten gelatin therein. The molten gelatin may for example be supplied at a temperature of about 140° F. The supply hopper 66 is designed to maintain the gelatin in its molten state. For this purpose, it is preferred that the hopper 66 be equipped with a plurality of fluid passageways 68 in the walls thereof through which a heated fluid, such as water, may be circulated in order to maintain the proper temperature of the molten gelatin mass to ensure that it remains in a molten state in the supply hopper 66 (see FIG. 4).

The supply hopper 66 is suitably supported relative to the cylindrical surface of the casting drum 38 so that the molten gelatin therein continuously flows through a longitudinally extending opening 70 at the lower end thereof onto the web forming surface of the casting drum 38. More particularly, a deflecting blade 72 is provided along the bottom edge of the gelatin supply hopper 66 adjacent one side of the longitudinal opening 70 for deflecting molten gel onto the surface of the casting drum 38. A doctor blade 74 is fixedly positioned to the gelatin supply hopper 66 at its lower end adjacent the opposite side of the longitudinal opening 70 so as to extend downwardly beyond the lower edge of the gelatin supply hopper 66. As will be appreciated, the spacing between the lower edge of the doctor blade 74 and the surface of the casting drum 38 will define the thickness of the gelatin layer deposited onto the casing drum 38 as the drum 38 rotates. As is well known in the art, the molten gelatin substantially immediately solidifies or gels as it is deposited onto the relatively cool surface of the casting drum 38. In this regard, the room temperature for the apparatus 20 is typically approximately 60° F. and the casting drum 38 is maintained at approximately 68° F. by the circulation of air through the substantially hollow interior thereof. For this purpose, the support rings 58 at the axial ends of the casting member 56 have suitable openings 76 therethrough.

In order to precisely control the thickness of the formed gelatin web 24 within desired ranges, in accordance with one aspect of the present invention, the gelatin supply hopper 66 is supported on a support bar 78 which extends across the width of the casting drum 38 and which is supported at its ends by suitable adjustment mechanisms 80. These adjustment mechanisms 80 control the height of the gelatin supply hopper 66 relative to the gelatin forming surface of the casting drum 38. More particularly, the gelatin supply hopper 66 has a U-shaped bracket 82 secured on its rear surface by means of suitable bolts or fasteners 84. The support bar 78 which extends across the width of the casting drum 38 is adapted to be received within the U-shaped recess of the bracket 82. At each end, the lower surface 86 of the support bar 78 is inclined downwardly toward the center of the bar, as can best be seen in FIG. 2. The support bar 78 is supported at each end by an adjustable roller member 88 which is movable toward and away from the center of the bar 78 and on which the inclined surface 86 of the bar 78 rests. It will be appreciated that the elevation of each end of the support bar 78 is controlled by the position of the roller member 88 relative to the end of the support bar 78. That is, the farther inwardly the roller member 88 is positioned, the higher the elevation of the end of the support bar 78; conversely, the farther the roller member 88 is positioned outwardly toward the end of the support bar 78, the lower the elevation of the end of the support bar 78.

The roller members 88 are supported at the opposite ends of the casting drum 38 by bracket members 90 which are pivotally mounted to pivot about a pivot pin 92 secured to the main frame structure for the overall apparatus 20. As can best be seen in FIG. 4, the pivot pin 82 for the bracket members 90 is spaced away from the surface of the casting drum 38. Each of the bracket members 90 has a support roller 94 journalled therein which is adapted to ride along the outer shoulder or cylindrical surface 64 of the pair of support rings 58 as the casting drum 38 rotates. As noted hereinabove, the cylindrical surfaces 64 are each concentric with the gel forming surface of the casting member 56, but are spaced axially therefrom at the opposite ends of the casting member 56. Thus, it will be appreciated that the position of the bracket members 90 will remain in fixed relationship with respect to the gel forming surface of the casting drum 38 as the casting drum 38 rotates about its axis.

Figure 2:
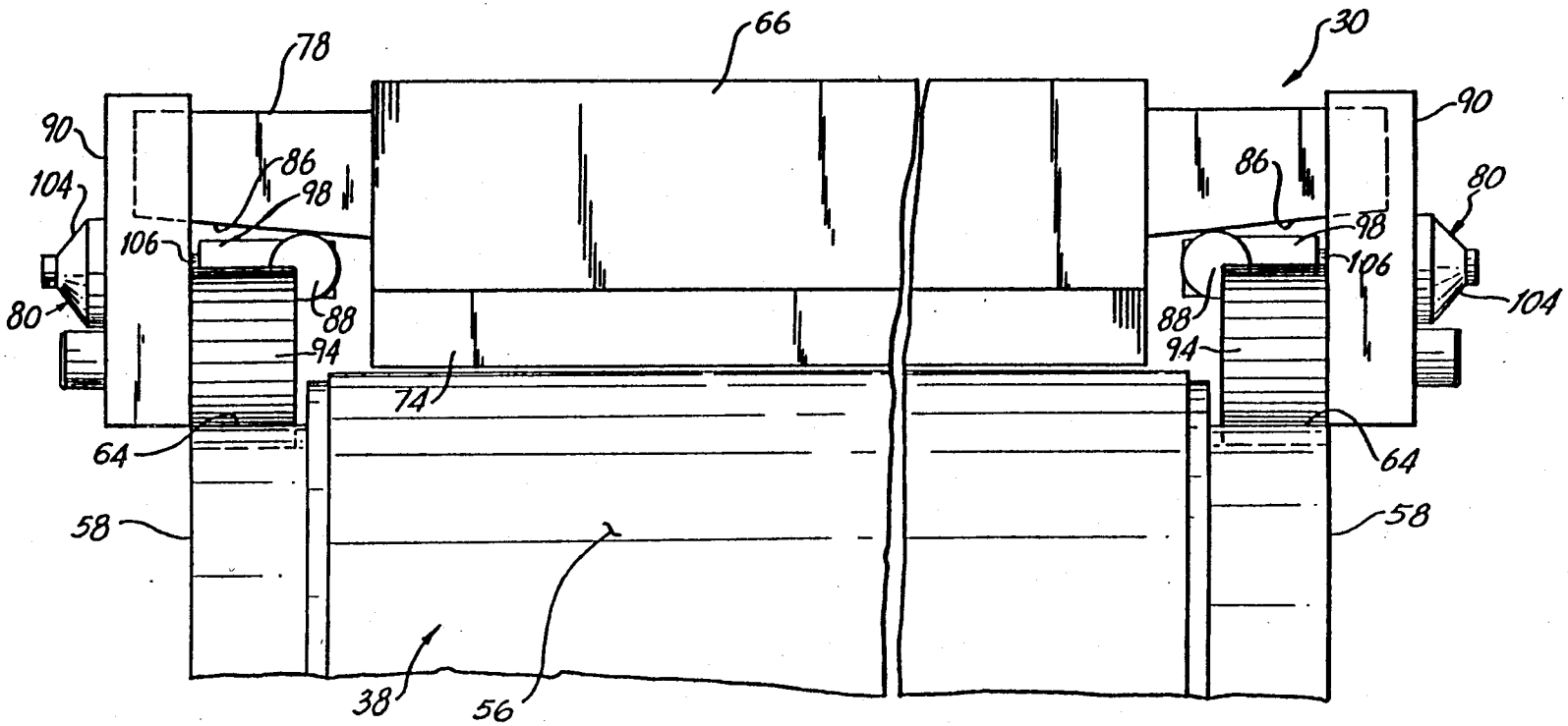
FIG. 2 is a side sectional view of a portion of the apparatus shown in FIG. 1 in accordance with the present invention.
Figure 3:
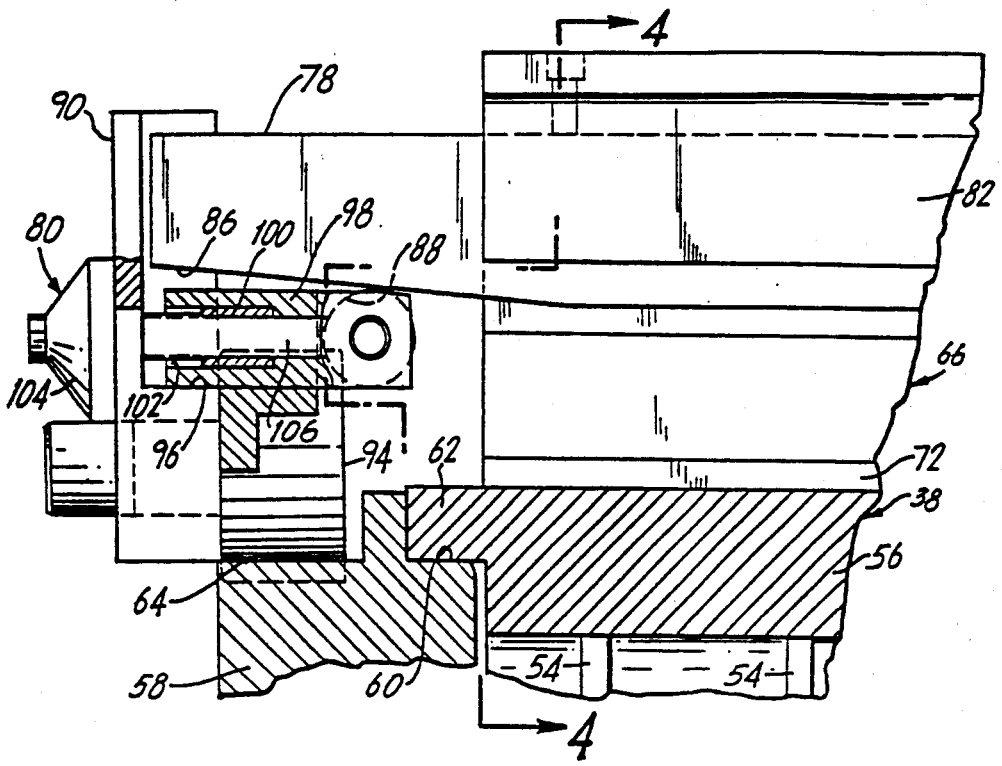
FIG. 3 is an enlarged side elevational view of the portion of the apparatus shown in FIG. 2, illustrating the means for adjusting the thickness of the web being formed.
Figure 4:
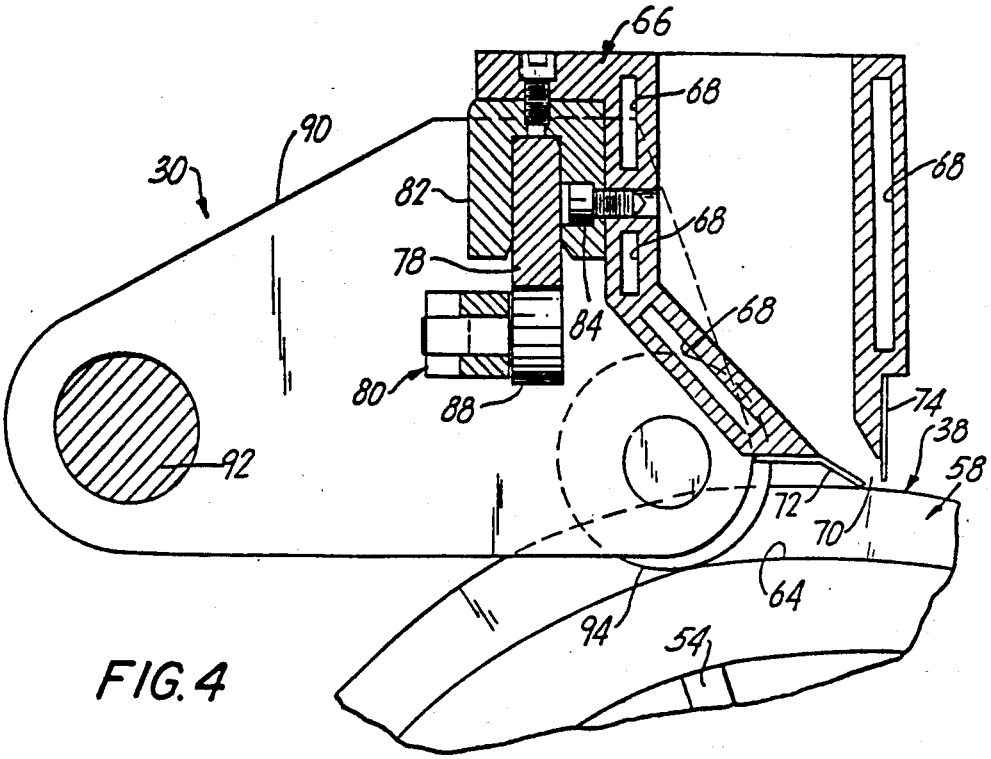
FIG. 4 is a sectional view taken along lines 4—4 of FIG. 3.

Each bracket member 90 includes a support ledge 96 on which a slidable block member 98 is supported for sliding movement toward and away from the center of the casting drum 38 (see FIG. 3). Each of the slidable support blocks 98 of the bracket members 90 carries one of the roller members 88 for supporting the ends of the support bar 78, as best seen in FIGS. 2 and 3. In order to adjust the position of the block member 98 on the support ledge 96 of the bracket 90, the block member 98 includes a recess 102 in the end thereof facing the side wall of the bracket 90 which has a threaded bushing 100 therein. On the opposite of the side wall of the bracket 90 there is provided a dial 104 having a threaded shaft 106 which extends through the side wall and is received in the threaded bushing 100 in the slidable block member 98. The threaded shaft 106 may preferably comprise a fine pitch micrometer thread or screw, which for example is capable of adjusting the position of the block member 98 in increments of 0.0005 inch.

Thus, it will be appreciated that rotation of the dial 104 will cause the slidable block member 98 to slide towards or away from the bracket member 90, i.e., from right to left, or vice versa, as shown in FIG. 3, depending upon the rotation of the threaded shaft 106, to thereby adjust the position of the roller member 88 carried thereby relative to the end of the support bar 78. Since the elevation of the support roller 94 remains in fixed relationship to the surface of the casting drum 38, adjustment of the position of the roller member 88 is used to adjust and control the position of the support bar 78 and thus the position of the gelatin supply hopper 66 relative to the casting surface of the casting drum 38. More particularly, if each slidable block member 96 is moved inwardly away from its bracket member 90, the support bar 78 and gelatin supply hopper 66 will be raised, whereas if the block members 96 are moved outwardly toward their respective bracket members 90, the support bar 78 and gelatin supply hopper 66 will be lowered. This adjustment of the position of the gelatin supply hopper 66 in turn adjusts the position of the doctor blade 74 affixed to the gelatin supply hopper 66. It will thus be appreciated that a very precise and finely controlled adjustment of the position of the doctor blade 74 may be made with the disclosed apparatus 30. Additionally, it is possible to independently control the elevation of the ends of the support bar 78 to compensate for thin or thick areas of molten gelatin laid down on the casting drum 38 so that a substantially uniform thickness web 24 is produced.

It should be appreciated that the disclosed apparatus 30 for casting gelatin webs 24 is not subject to the disadvantages of the prior art since the gelatin supply hopper 66 and doctor blade 74 are supported so as to ride on support surfaces 64 which are spaced from the gel forming surface, and not on the gel forming surface itself. Specifically, the doctor blade 74 is fixedly positioned in the gelatin supply hopper 66 and the position of the gelatin supply hopper 66 is controlled with respect to the circumferential surfaces 64 on the ring members 58 which are axially spaced from the casting surface and concentric thereto. Thus, control of the position of the doctor blade 74 is completely independent of any films which may be formed on the casting surface. Additionally, the adjustment of the thickness of the gelatin webs 24 does not involve adjustment of the position of the doctor blade 74 relative to the gelatin supply hopper 66. Accordingly, adjustment mechanisms 80 will be not subjected to any damage during cleaning of the gelatin supply hopper 66 between different batch runs.

In the preferred embodiment, the casting drums 38 each have a diameter of approximately thirty inches. The width (or axial length) for the casting surface may be any desired dimension, such as for example six inches up to approximately thirty-four inches if desired. It of course will be appreciated that the casting drum 38 can be used for the formation of webs 24 which are narrower than the width of the casting surface by simply controlling the amount of gelatin material deposited thereon. Also, the clearance between the edge of the doctor blade 74 and the gel forming surface on the casting drum 38 may preferably range between 0.012 and 0.040 inch which will thereby produce a gelatin web 24, after full cooling and dehydration, having a thickness on the order of 0.006 and 0.018 inch.

After the molten gelatin is cast onto the casting drum 38 and gels, it is directed beneath a shroud 108 which overlies the surface of the drum 38 and which has dry cool air flowing in a direction opposite to the direction of movement of the web 24. In other words, with reference to FIG. 1, the casting drum 38 on the left hand side of the figure rotates in a counterclockwise direction to move the gelatin web 24 initially through the left end of the shroud 108 so that it exits from beneath the right hand end of the shroud 108, and the air flow is directed in a clockwise direction about the casting drum 38. This air serves to dehydrate some of the water from the gelatin material and to help cool the molten gelatin so that a desired consistency is achieved.

After passing through the exit end of the shroud 108, the gelatin web 24 is directed to a printing/coating station 110. The printing/coating station 110 may be utilized for the printing of trade names, lot numbers or the like on the web 24 at the proper locations corresponding to the portions of the web 24 which will be used for the formation of capsules. Alternatively, or in addition to printing, the printing/coating station 110 may serve to coat a material on the inside of the gelatin web 24, such as for example an eatable shellac. This may be preferable in order to prevent breakdown of any powder fill material which is placed within the capsule. For instance, many types of powder fill material are subject to deterioration upon exposure to moisture. Since the gelatin webs 24, before dehydration, do hold a percentage of water, in order to prevent the moisture in the gelatin webs 24 from contacting the fill material, it is preferable to coat the inside surface of the web 24 with a suitable material to prevent such contact. This material may be applied at the printing/coating station 110.

The printing/coating station 110 may comprise an idler roller 40 about which the gelatin web 24 is trained and a printing/coating applicator 112, such as for example a trough having ink or coating liquid therein and a series of applicator rollers. After passing about the idler roller 40, the web is directed onto a secondary processing drum 42 which is similar to the casting drum 38. The secondary processing drum 42 includes an outer sleeve 114 having a solid outer cylindrical surface, the sleeve 114 being supported for rotation from a central shaft 116 by means of radially extending arms 118. Also, end ring members 120 are provided having openings 122 therethrough similar to ring members 58 for the casting drum 38. In the preferred embodiment, the secondary processing drum 42 is approximately thirty inches in diameter and has a main support surface which corresponds to the width for the casting drums 38. With such an arrangement, cool air may pass beneath the surface of the drum 42 to maintain the temperature of the drum 42 as desired so that the web 24 will remain at a proper consistency for subsequent formation. The secondary processing drum 42 also has a shroud 124 so that conditioned air may again be passed over the web 24 in a direction opposite to the direction of movement of the web to further dry and condition the gelatin web 24. In this regard, it is expected that further percentage of the web in the gelatin web 24 is driven off this location, for example an additional 12%.

Preferably, the secondary processing drum 42 is driven at a speed which is approximately 10% greater than the speed at which the casting drum 38 rotates in order to stretch the gelatin web 24 slightly in passing from the casting drum 38 to the secondary processing drum 42. Stretching of the web 24 slightly is desired at some time before the capsules 22 are formed in order to take up slack during the drying and also to allow the gelatin material to shrink about the fill material. If the web 24 is coated at the printing/coating station 110 with a coating which is not elastic, stretching of the web 24 after the coating dries might cause cracking or deterioration of the web 24. Therefore, it is preferable to stretch the web 24 slightly before any coating thereon dries.

After passing around the secondary processing drum 42, the gelatin web 24 is directed to a web oiling station 126 at which a lubricant or oil is applied to both surfaces of the web 24. In the preferred embodiment, the oiling station 126 includes a guide roller 44 which directs the web 24 downwardly to a first oiler roller 46. This oiler roller 46 may have a felt outer surface to which oil or other lubricant is applied through the main shaft thereof to thereby apply a coating of oil to one surface of the web 24 as the web 24 passes thereabout. A second oiler roller 48 for coating of the other side of the web 24, similar to the first oiler roller 46, is provided downstream of the first oiler roller 46. The lubricant may for example comprise a vegetable oil, and is particularly important for formation of capsules 22 having liquid fill material therein. Oiling of the web 24 may also be desired in certain instances with respect to capsules having dry fill powder therein.

Figure 5:
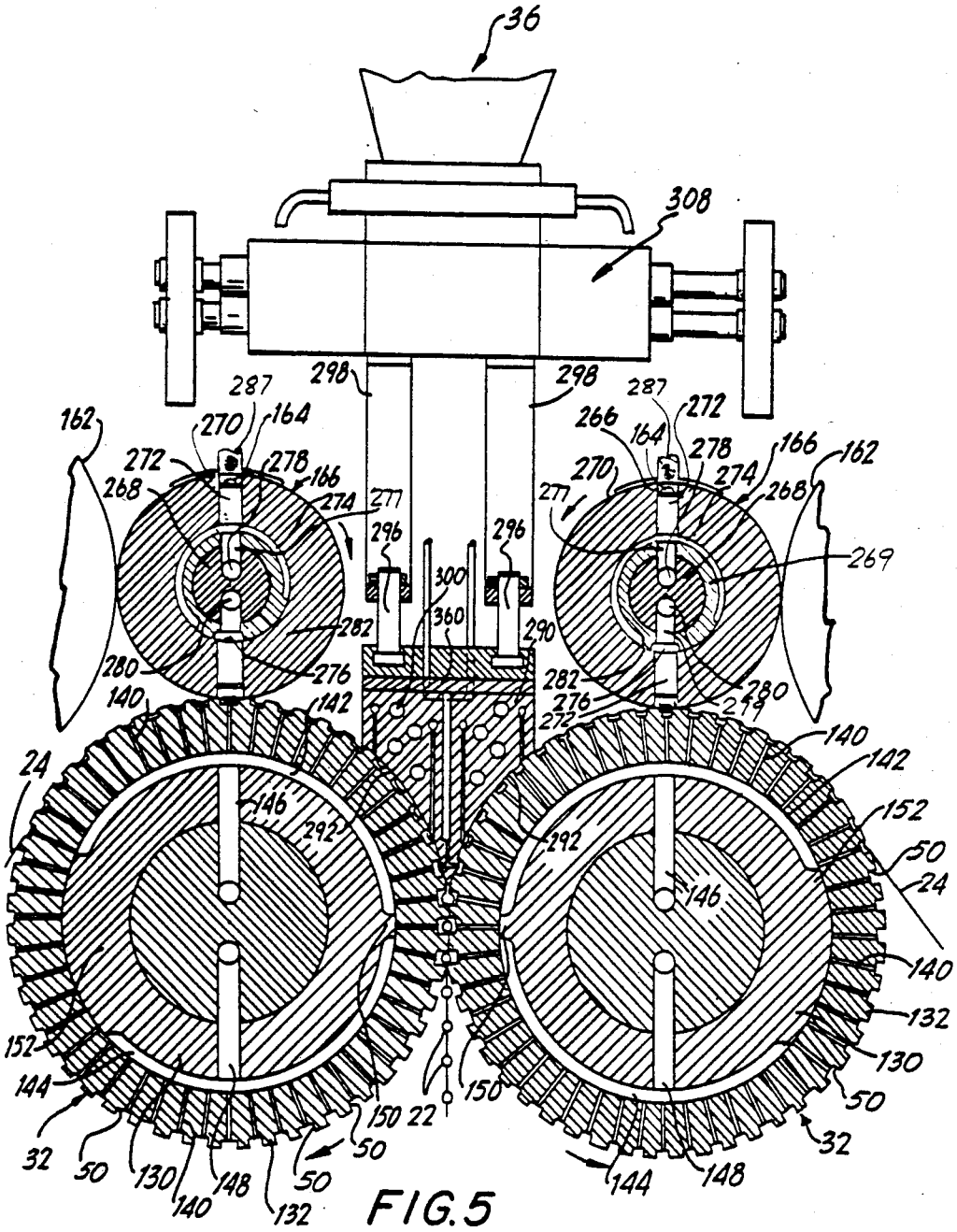
FIG. 5 is an enlarged end sectional view of a portion of the apparatus shown in FIG. 1, illustrating the sealing rolls and related apparatus in accordance with the present invention.

After passing from the last oiling roller 48, each web 24 is directed about a guide roller 128 onto the main sealing rolls 32. The pair of sealing rolls 32, which are each identical to one another, are arranged in a nipping relationship and adapted to rotate in opposite directions, so that the webs 24 will be directed therethrough. As seen in FIG. 5, each sealing roll 32 comprises a stationary central core member 130 and an outer annular sleeve member 132 adapted to rotate with respect to the central core member 130, the outer annular sleeve member 132 being driven by appropriate drive mechanisms and synchronized so as to be driven at a speed such that the gelatin webs 24 are not stretched or slackened in passing from the secondary processing drums 42 to the sealing roll 32. In this regard, the sealing rolls 32 in the preferred embodiment are each approximately ten inches in diameter and thus are driven at approximately three times the speed of rotation of the secondary processing drums 42. Also, the sealing rolls 32 are of a width corresponding to the width of the casting and secondary processing drums 38, 42.

Figure 6:
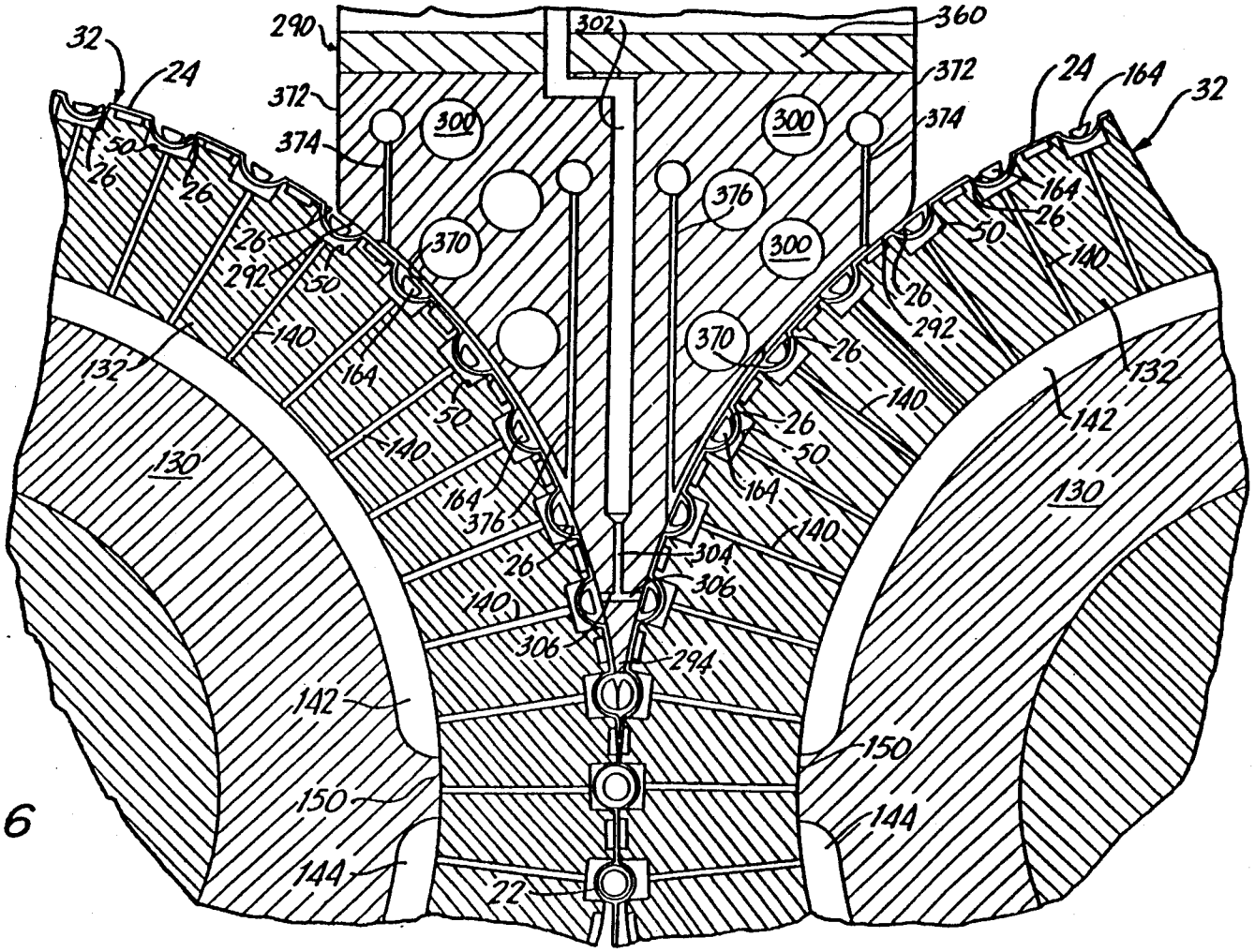
FIG. 6 is a still further enlarged end sectional view of a portion of the sealing rolls and wedge member positioned adjacent the nip of the sealing rolls.
Figure 7:
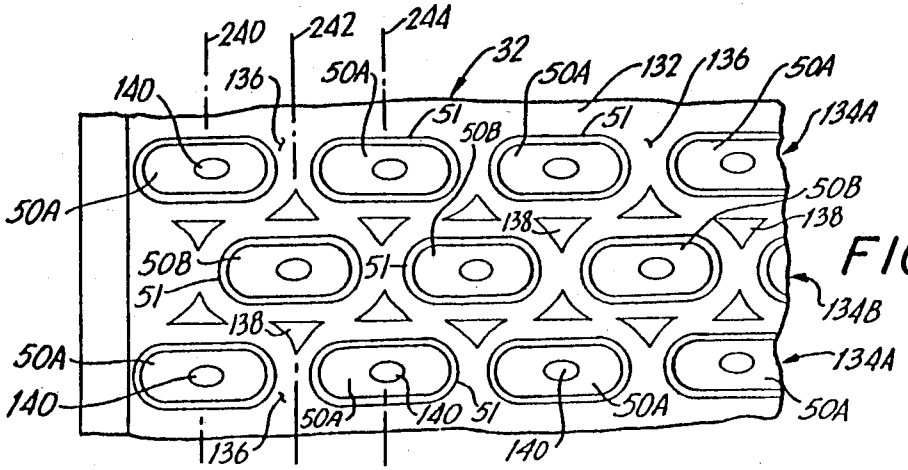
FIG. 7 is a plan view of a portion of the surface of one sealing roll.

Each annular sleeve member 132 has an outer surface which includes a series of depressions or recesses 50 therein for the formation of cavities or pockets 26 in the webs 24 to thereby define capsules halves. As can best be seen in FIGS. 5, 6 and 7, in the preferred embodiment, each of the depressions 50 is generally of an oblong shape (see FIG. 7) and is substantially rectangular in cross section (see FIG. 6). The series of depressions 50 on the surface of each sealing roll 32 are arranged in rows 134 extending along the axial length of the roll 32, with the series of rows progressing about the circumference of the sealing roll 132 (see FIG. 7). The depressions or recesses 50 of adjacent rows are offset with respect to one another, i.e., the one row 134A along the length of the sealing roll 32 has one arrangement of depressions 50A which correspond with and are in axial alignment with the depressions of the third row 134A, shown in FIG. 7, whereas the depressions 50B of the second row, shown in FIG. 7, are shifted along the axis length of the sealing roll 32 approximately one-half the distance between the centers of the adjacent depressions 50A so that the center of the depressions 50B in the second row 134B are intermediate the depressions 50A in the first and third rows 134A. For simplicity purposes, the depressions 50A of the first and third rows 134A will be referred to as the "A" series or pattern of depressions 50A, and the depressions 50B in the adjacent rows 134B as the "B" series or pattern of depressions 50B. It will be appreciated that the number of recesses 50A in each row 134A of the A series will be one greater than the number of depressions 50B in each row 134B of the B series. In the preferred embodiment, for example, the number of capsule defining recesses 50A in each row 134A of the A series is 33 and the number in each row 134B of the B series is 32.

In this regard, each of the capsule forming depressions or recesses 50 in the surface of the sealing roll 32 is defined by a land or shoulder 51 which extends outwardly from the bottom of the recessed area 50. Additionally, between each of the main capsule forming recesses 50, the surface of the roll 32 includes additional relieved areas or sections 136 which are shaped so as to define a series of triangularly shaped lands 138 between the shoulders 51 defining the cavity forming recesses 50 (see FIG. 7). These lands 138 aid in holding the gel webs 24 to prevent sliding or slippage thereof relative to the sealing roll 32 as a result of the lubricating oil which is applied to both sides of the gelatin web 24. As can best be seen in FIG. 7, these lands 138 are located between the rows 134 of recesses or cavities 50 with one triangular tip thereof extending slightly between adjacent recesses 50 in each row 134.

Each of the recesses 50 in the surface of the rotatable sleeve 132 includes a radially extending passageway 140 which extends from the bottom surface of the recess 50 to the inner cylindrical surface of the sleeve member 132. The core member 130 of the sealing roll 32 in turn has a pair of circumferential recessed areas 142, 144 which are spaced radially inwardly from the inner surface of the rotating sleeve member 132 and which extend about respective portions of the circumference of the core member 130. These circumferential recess areas 142, 144 extend substantially the entire axial length of the core member 130 and are closed or sealed at their ends. One of the circumferential recesses 142 communicates through a port 146 with a source of vacuum or reduced pressure, which vacuum or reduced pressure is in turn applied through the radial passageways 140 to the bottom of each of the recesses 50 when such passageways 140 are in communication with the circumferential recess 142. The other circumferential recess 144 communicates through a port 148 with a source of air pressure which is communicated to the bottom of the recesses 50 when the radial passageways 140 thereof are in communication with this circumferential recess 144. The pair of circumferential recesses 142, 144 are maintained separate from one another by virtue of the circumferential raised sealing surfaces 150, 152 on the core member 130 which serve to seal against the inner cylindrical surface of the rotating sleeve member 132. As will be appreciated, as the sleeve member 132 of the sealing roll 32 rotates about the core member 130, different radial passageways 140 come into communication, respectively, with the vacuum in the circumferential recess 142 and with the pressurized air in the circumferential recess 144, and remain in communication therewith until such passageways 140 move past the raised surfaces 150, 152, respectively.

One side of the circumferential recess 142 communicating with the source of vacuum is located adjacent the circumferential location that the gelatin web 24 comes into contact with the sleeve member 132. As the gelatin web 24 contacts and covers the raised shoulders or lands 51 about the recesses 50, the source of vacuum communicating with the bottoms of the recesses 50 serves to stretch or pull portions of the web 24 downwardly within the recesses 50 and form a series of pockets 26 thereon, one pocket 26 in each recess 50. As best seen in FIG. 6, each pocket 26 formed in the surface of the web 24 is substantially semi-circular in cross-section. These pockets 26 formed in the web 24 serve as cavities for receipt of a pharmaceutical fill material, which is deposited therein as the web 24 is moved about the sealing roll 32, and as will be described more fully hereinbelow.

The vacuum in the recess 142 is continuously applied to the recesses 50 to hold the pockets 26 in place as the sealing roll 32 rotates until the radial passageways 140 for particular recesses 50 rotate past the raised surface or section 150 which is adjacent the nip of a pair of sealing rolls 32. Specifically, as each row 134 of recesses 50 approaches the nip, their radial passageways 140 are closed off by the surface 150 on the core member 130. Subsequently, as the sealing rolls 32 continue to rotate, the respective passageways 140 are brought into communication with the circumferential recess 144 communicating with the source of pressurized air. This occurs just after the corresponding row 134 of recesse 50 has passed through the nip. The pressurized air serves to force the portions of the web 24 in the recesses 50 thereoutof. The passageways 140 remain in communication with the recess 144 and subjected to air pressure until they pass the raised surface 152 on the core member 130, and thereafter the passageways 140 again communicate with the source of vacuum in recess 142 to pull or stretch a new portion of the web 24 downwardly into the recesses 50.

The series of recesses 50 or depressions on each of the sealing rolls 32 are arranged on the surfaces thereof, and the sealing rolls 32 rotated in unison and synchronized so that the recesses 50 on one of the sealing rolls 32 are brought into juxtaposition and aligned with respective recesses 50 on the other sealing roll at the nip of the sealing rolls 32. that is, for example, an A series of recesses 50A on one sealing roll 32 are precisely aligned with a corresponding A series of recesses 50A on the other sealing roll 32 at the nip, and thereafter, as the sealing rolls 32 are continued to be rotated, respective B series of recesses 50B on the sealing rolls 32 are brought into juxtaposition and aligned at the nip, and so on. Accordingly, as pockets 26 are formed in the pair of gelatin webs 24 at the locations of the recesses 50 on the surface of the sealing rolls 32, the pockets 26 in the respective webs 24 are also brought into juxtaposition and alignment at the nip between the rolls 32. At the nip between the sealing rolls 32, the shoulders or lands 51 surrounding each recess 50 of the respective sealing rolls 32 press against one another to thereby seal the gelatin webs 24 together about the circumference of each of the pockets 26. In other words, at the nip, the pair of gelatin webs 24 are fused together about each of the respective pockets 26.

As more fully described hereinbelow, after creation of the pockets 26 but before the pockets 26 are advanced to the nip, a suitable pharmaceutical fill material is deposited in each pocket 26. Thus, when the pockets 26 are advanced through the nip and sealed, they are sealed with the fill material therein to thus form completed pharmaceutical capsules 22. Also, as will be more fully described hereinbelow, the temperature of the portions of the pair of webs 24 is preferably elevated slightly just prior to the portions being moved into the nip so that the webs 24 will effectively be sealed about the pockets 26 in each web 24 by the action of the lands or shoulders 51 on the sealing rolls 32 pressing against one another. Still further, as noted above, the sealing rolls 32 are preferably each ten inches in diameter. This size is advantageous in allowing for a longer dwell time at the point of sealing, thereby ensuring that effective seals are created. The formed capsules 22 after passing through the nip fall out into troughs located therebelow as the sealing rolls 32 continue to rotate and the web sections 24 move downwardly. Any formed capsules 22 that may be loosely held in the web section 24 are removed therefrom by means of rotating paddles 156.

The apparatus 20 in accordance with the present invention is operative to deposit either a solid or dry powder fill material into the pockets 26 in the webs 24 as they move along on the sealing rolls 32, or a liquid fill material, or both a solid and liquid fill material, depending upon the end use of the capsules 22. If dry fill powder is to be deposited, the apparatus 20 includes means 34 for forming compacted slugs of a precisely predetermined quantity and depositing them in each of the pockets 26 as the webs 24 pass about the sealing rolls 32, while minimizing possible contamination of the webs 24 with dust or loose powder material which might otherwise prevent or hinder the formation of completely sealed capsules 22. If a liquid fill material is to be deposited, the apparatus includes means 36 for depositing a precise quantity of liquid fill material in each of the pockets 26 just prior to the pockets 26 being brought into juxtaposition at the nip of the sealing rolls 32. Both of these means 34, 36 for depositing a dry fill powder and liquid fill material are operative independently of one another so that both dry fill powder and liquid fill material may be deposited in each of the pockets 26 if desired.

The dry powder fill apparatus 34 is shown more particularly with reference to FIGS. 5, 8, 9*a*, 9*b*, 10 and 11 and comprises generally a dry powder supply hopper 160 containing a supply of dry pharmaceutical fill powder, a punch roll 162 for precisely measuring out a predetermined quantity or charge of dry powder and for compacting the dry fill powder into compacted slugs 164, and a transfer roll 166 for transferring the compacted slugs 164 from the punch roll 162 and depositing them into the cavities or pockets 26 formed in the gelatin web 24 passing about the sealing rolls 32. Such a dry fill powder apparatus 34 is provided for each of the sealing rolls 32 in accordance with the present invention, and thus only one such apparatus 34 will be described.

Also, as noted above, a number of cavities or pockets 26 are provided in each row in the web 24 along the axial length of the sealing rolls 32. The punch and transfer rolls 162, 166 in accordance with the present invention serve to deposit a compacted slug 164 of dry fill material, substantially free of dust or loose uncompacted material, into each pocket 26 in each row along the axial length, as well as to deposit slugs 164 of compacted fill material into pockets 26 in each row arranged about the circumference of the sealing rolls 32. However, for simplicity of description, the basic apparatus 34 will generally be described with reference to simply depositing a single or series of compacted slugs 164 into one or a series of cavities located at one axial position on the gelatin web 24, it being realized that a plurality of similar components are provided along the axial length of the punch and transfer rolls 162, 166 so that a plurality of compacted slugs 164 are substantially simultaneously deposited in each of the pockets 26 provided in each row. Also, although only four stations will be shown about the circumference of each of the punch rolls 162 and two stations about the circumference of each transfer roll 166, it will be appreciated that the number of stations could be greater or less, depending on the speed of rotation of the various rolls 162, 166, in order to ensure that as each pocket 26 is moved past the transfer roll 166, a compacted slug 164 of dry fill material will be deposited thereinto.

Figure 8:
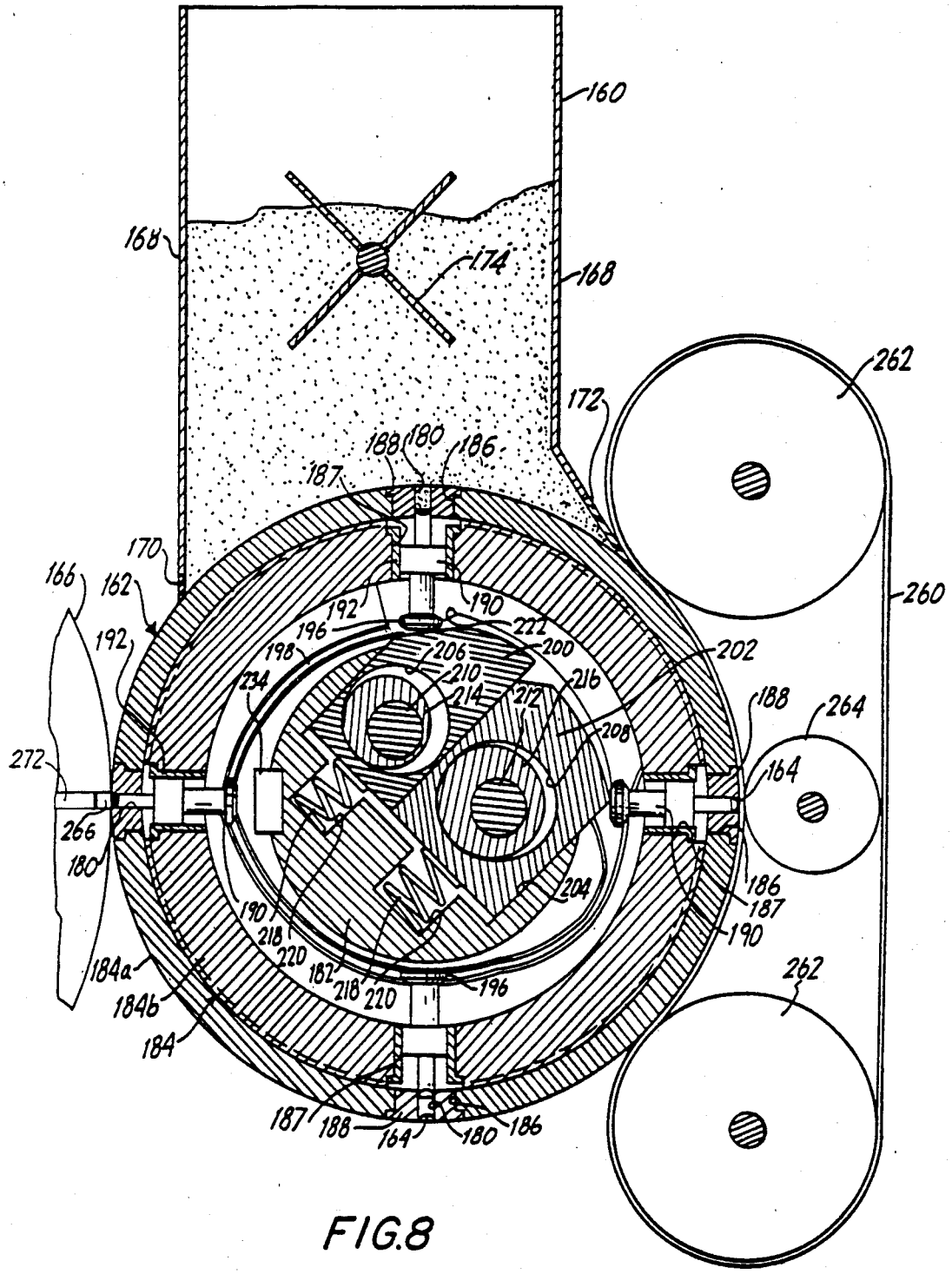
FIG. 8 is an enlarged end sectional view of a portion of the apparatus shown in FIG. 1, illustrating the punch roll and weight adjustment and compaction cam mechanisms for forming compacted slugs in accordance with the present invention.

As best seen in FIGS. 1, 5, 19 and 20, the transfer roll 166 is mounted for rotation directly above its respective sealing roll 32 so that the axes of rotation are vertically aligned, and the punch roll 162 is mounted for rotation laterally to one side of its respective transfer roll 166 so that the axes of rotation thereof are horizontally aligned. The supply hopper 160 is supported vertically above its respective punch roll 162. In essence, the powder supply hopper 160 sits on the surface of the punch roll 162 and has suitable side walls 168 and end walls (not shown) for maintaining a supply of dry fill powder therein. Flexible sealing members 170, 172 are provided at the lower ends of the side walls 168 for engaging the surface of the punch roll 162 to maintain the supply of dry fill powder within the hopper 160. As best seen in FIG. 8, the fill powder covers that portion of the surface of the punch roll 162 which is located between the side walls 168 within the hopper 160. The hopper 160 also includes a rotatable paddle 174 for agitating the powder to provide fine granules or powder to facilitate filling chambers 180 in the punch roll 162.

The punch roll 162 includes a stationary cylindrical core member 182 and a rotatable annular outer housing 184 comprised of an outer ring member 184*a* and an inner annular ring member 184*b*. The outer ring member 184*a* includes a plurality of radially extending apertures 186 therein about the circumference and along the axial length thereof. Each of these openings 186 has a die member 188 mounted therein. The die members 188 each have radially extending openings therethrough which define charging chambers 180 for receiving a charge of fill powder. The die members 188 may be removed and replaced with different die members to change the configuration of the chamber opening, if desired. The inner annular ring member 184*b*, which is secured to the outer annular member 184*a* so as to rotate therewith, also has a plurality of radially extending openings 187 therein aligned with the openings 186 in the outer ring member 184*a*. A plurality of punch members 190 housed in bushings 192 are mounted within each of the radially extending openings 187. Each of the punch members 190 is slidable radially within its respective bushings 192, and includes a punch head 194 which is slidably received within the chamber opening 180 of its respective die member 188. The punch head 194 includes an end which is shaped to correspond in shape to the die cavity or pocket 26 formed in the gelatin web 24, i.e., semi-circular in cross section and of an oblong nature in the preferred embodiment.

The number of punch members 190 and corresponding die members 188 provided about the circumference of the punch roll 162 may vary depending on the anticipated speed of rotation of the punch roll 162 with respect to the rotational speed of the sealing roll 32, as explained more fully hereinbelow. In the preferred embodiment, four such punch members 190 are shown at each axial location of the punch roll 162. In this regard, it will be recalled that the pockets 26 are formed in the webs 24 in rows which extends across the width of the web 24 (i.e., along the axial length of the sealing roll 32, see FIG. 7), and also that the arrangement of the pockets 26 (as a result of the recesses 50 in each roll 32) is offset for alternating rows. As the punch rolls 162 are operative to produce a compacted slug 164 of dry fill material for each pocket 26, punch members 190 and die members 188 are provided along the axial length of the punch roll 162 corresponding to the number and location of the pockets 26 formed in the rows of pockets 26 in the web 24, as also will be explained more fully hereinbelow with reference to FIG. 11. For the time being, it simply should be noted that a plurality of punch and die members 190, 188 are provided about the circumference and along the axial length of the punch roll 162.

The radially innermost end of the punch member 190 includes a cam head 196 thereon which is adapted to ride within a cam track 198 stationarily fixed with respect to the core member 182 as the inner and outer ring members 184*a*, 184*b* are rotated thereabout. The cam track 198 for the punch members 190 serves to guide the punch members 190 for movement in a radial direction as the punch roll 162 rotates about the central core member 182, according to a desired pattern of movement to be described more fully hereinbelow. Along a portion of the circumference, the cam track 188 is open and does not serve to control the precise positioning of the punch members 190 as the punch members 190 move therepast. Rather, at this location, the positioning of the punch member 190 is controlled by a weight adjusting cam member 200 and a compaction adjustment cam member 202. These two cam members 200, 202 extend along the axial length of the core member 182 and their position may be changed or adjusted to provide for a different amount of material to be recieved within each chamber 180 and to provide for different compaction force to be applied to produce a compacted slug 164.

Figure 9A:
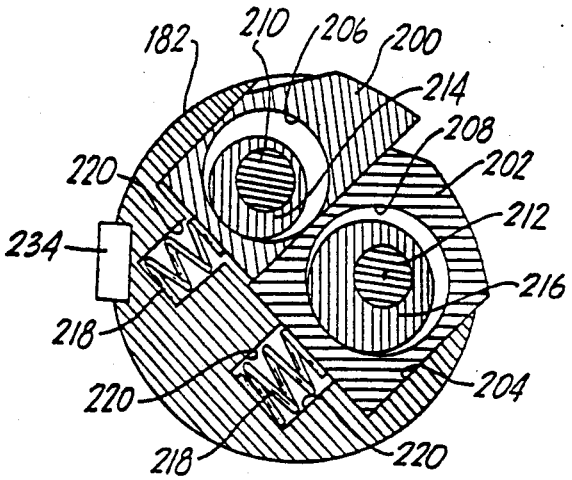
FIGS. 9*a* and 9*b* are partial end sectional views illustrating different positions of the weight adjustment and compaction cam members.
Figure 9B:
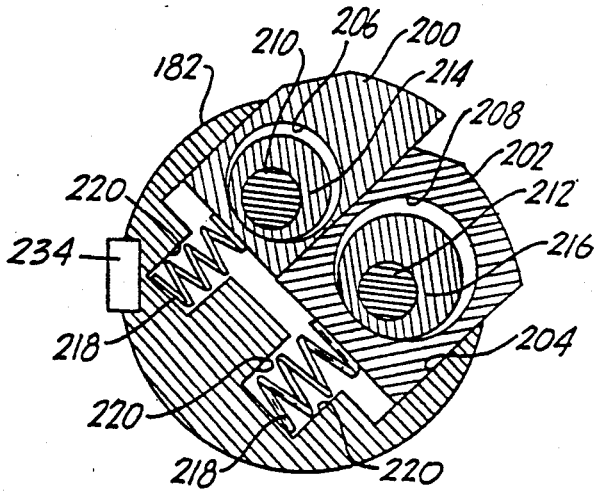
Figure 11:
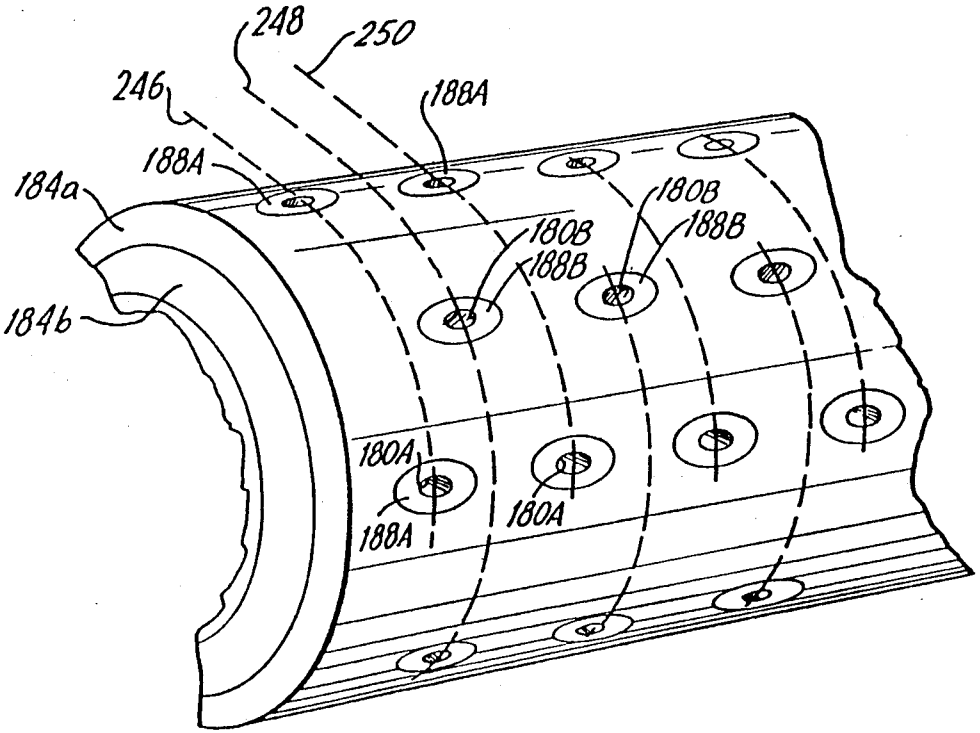
FIG. 11 is a partial perspective view of the punch roll.

More particularly, the stationary core member 182 is generally of a cylindrical shape and has a U-shaped recess 204 cut through one side thereof for receipt of the weight adjustment cam member 200 and compaction cam member 202. Each of these cam members 200, 202 comprise a longitudinally extending member which is supported for sliding movement into and out of the recessed 204 of the central core 182. Each cam member 200, 202 also includes a hollowed out cylindrical recess 206, 208 area which is adapted to receive a rotatable shaft 210, 212 which has a plurality of eccentrically mounted discs 214, 216 thereon (see FIGS. 8 and 10). A series of pockets 220 are provided beneath each of the cam members 200, 202 at the locations of the eccentric discs 214, 216 for receipt of spring devices 218, such as bevel springs. In this manner, the springs 218 force the cam members 200, 202 in a direction out of the U-shaped recess 204 so that the lower surfaces of the circular recesses 206, 208 will be in engagement with the eccentrically mounted discs 214, 216 on the shafts 210, 212. Thus, depending upon the rotational position of the eccentrically mounted discs 214, 216, the cam members 200, 202 may be moved between a fully retracted position (such as shown in FIG. 9*a*) in which the axis of rotation of the shafts 210, 212 are located at a maximum from the portion of the surfaces of the cylindrical recesses 206, 208 which are adjacent the springs 218, or a fully extended position (as shown in FIG. 9*b*) in which the distance from the axis of rotation to the portion of the surfaces of the circular recesses 206, 208 which are adjacent the springs 218 is a minimum. Of course, each cam member 200, 202 may be adjusted independently of the other.

Figure 10:
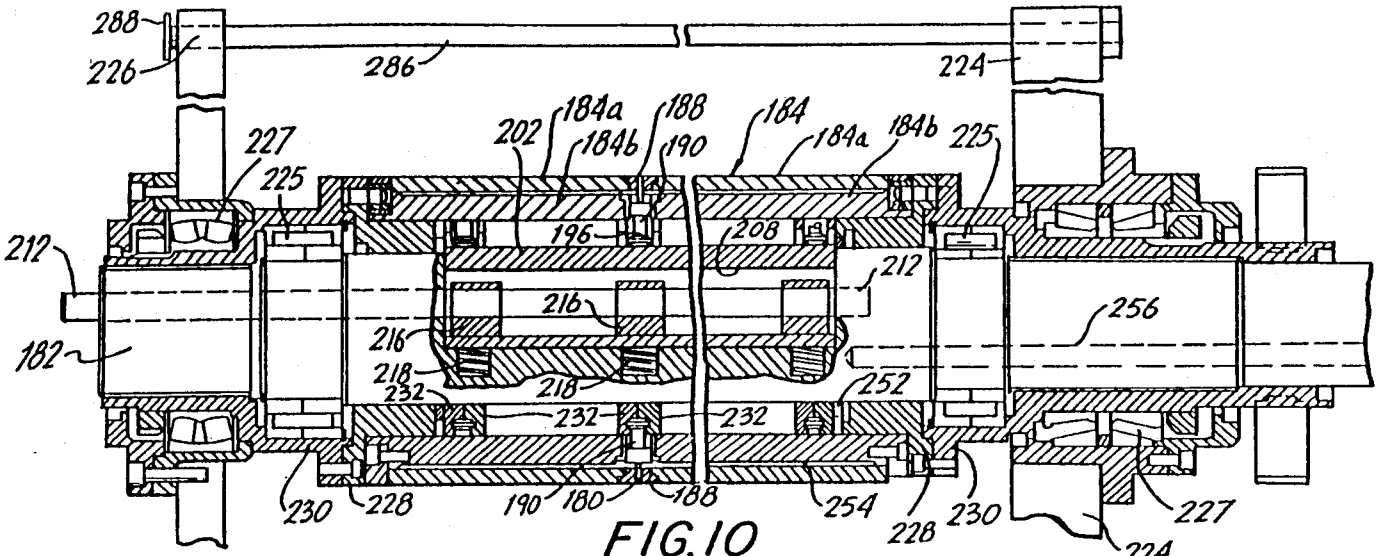
FIG. 10 is a side sectional view of the punch roll.

As best seen in FIG. 10, the shafts 210, 212 to which the eccentric discs 214, 216 are mounted extend axially outwardly beyond the forward end of the punch roll 162. In this regard, it will thus be appreciated that it is possible to adjust the weight of the compacted slugs 164 of fill material as well as the compaction force while the machine is in operation by simply rotating the shafts 210, 212 to rotate the eccentric discs 214, 216 to in turn adjust the position of the weight adjust cam member 200 and the compaction cam member 202. This feature of adjustability during the machine operation is most important since measurements of the desired weight of the material during operation can be utilized to correct for any deviations which are detected.

While the cam head 196 of each punch member 190 is confined within the cam track 198, the movement of the punch member 190 along the predetermined path is basically the same irrespective of the amount of material received in the chamber 180 and/or the compaction force applied. However, as the camming head 196 leaves the cam track 198 at the open section 222 (see FIG. 8), the position of the punch member 190 is controlled by the camming surface of the weight adjusting cam member 200 as the inner and outer ring members 184*a*, 184*b* continue to rotate. After the camming head 196 moves past the weight adjustment cam member 200, its positioned is then controlled by the camming surface of the compaction cam member 202 whose position is also variable to provide for a different compaction force to be applied. Upon leaving the compaction cam member 202, the camming head 196 is again directed into the camming track 198 which controls movement of the punch members 190 upon continued rotation of the inner and outer ring members 184*a*, 184*b*.

Figure 13:
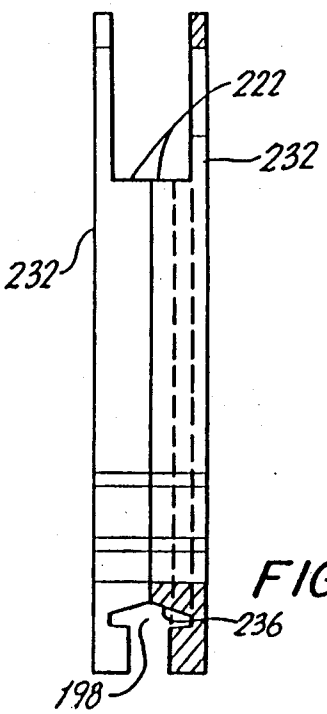
FIG. 13 is a side elevational view of a pair of cam track rings.
Figure 12:
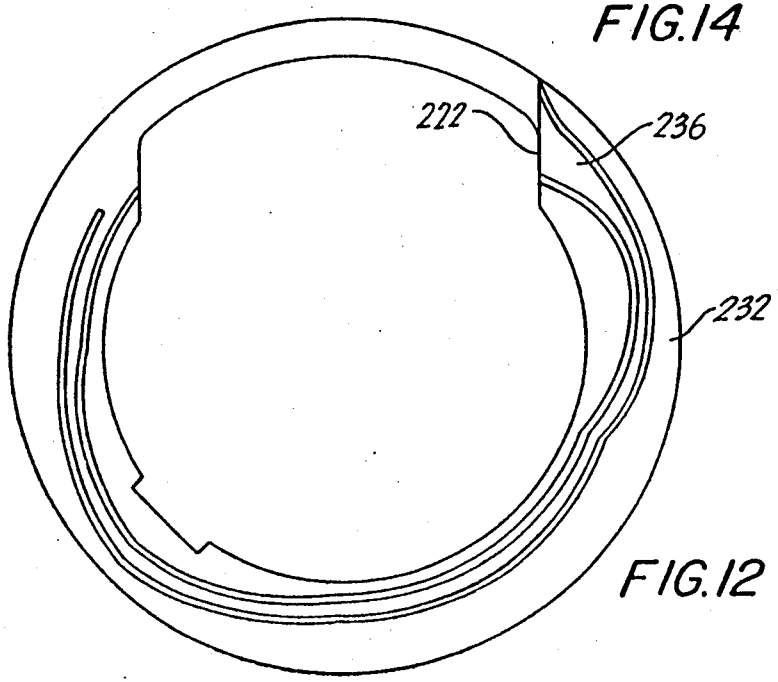
FIG. 12 is an end elevational view of a cam track ring utilized in the punch roll.

The cam tracks 198 for the various punch members 190 comprise a pair of cam track halves 232 which are adapted to be slid over the central core member 182 and locked against rotational movement by means of a key block 234 extending axially along the core member 182 (see FIG. 8). Each cam half member 232 has grooved surfaces 236 on one of the side faces thereof so that a respective pair of cam track halves 232 define the desired cam track 198 for the cam heads 196 of the punch members 190 (see FIG. 13). A portion of the grooved surface 236 of each cam track half 232 is removed at the circumferential position corresponding to the weight adjustment and compaction cam members 200, 202 to define an open section 222 for the punch members 190 to drop into engagement with the weight adjust and compaction cam members 200, 202. This open section 222 is also advantageous for changing punch members 190, bushings 192, die members 188, etc., to provide for different slug shapes and sizes.

The cam track halves 232 are so dimensioned that they may be stacked in side by side relationship on the central core member 182 with the mating surfaces for each cam track half 232 of a respective pair being aligned with the axis of the corresponding punch members 190 whose cam heads 196 are received in the cam track 198 defined thereby. In this regard, the punch members 190 are axially spaced along the punch roll 162 so as to correspond to one-half the spacing between the centers of the adjacent recesses 50 in a row 134 of recesses 50 on the sealing roll 32. That is, the centerline of axially adjacent punch members 190 corresponds to the axial spacing between the center of an A series recess 50A and the center of an adjacent B series recess 50B, i.e., the spacing between the centerline 240, 242 on FIG. 7. Here, it should be noted that the axially adjacent rows of punch members 190 and die members 188 on the punch roll 162 serve different rows 134 of recesses 50 in the sealing roll 32. It is also to be noted that the punch members 190 and die members 188A serving the A series of recesses 50A are circumferentially offset from the punch members 190 and die members 188B serving the B series of recesses 50. Four four punch members 190 arranged circumferentially about the punch roll 162 at each axial location on the punch roll 162, the circumferential or angular offset for axially adjacent punch members 190 is 45°, i.e., the punch members 190 and die members 188B for the B series recess are each positioned 45° about the circumference of the punch roll 162 from the punch members 190 and die members 188A for the A series recesses 50A. (This is shown best in the perspective view of FIG. 11.) Here, it will be noted that the spacing between the centerlines 246 and 248 on FIG. 11 correspond to the spacing between the centerline 240, 242 on FIG. 7, and also the spacing between the centerlines 246 and 250 on FIG. 11 correspond to the spacing between the centerlines 240 and 244 in FIG. 7.

The stationary core member 182, as best seen in FIG. 10, is stationarily supported at its opposite axial ends between a rear wall 224 and a forward support bar 226. The stationary core member 182 has suitable bearings 225 disposed on its opposite ends for supporting the inner and outer cylindrical ring members 184*a*, 184*b* for rotational movement relative thereto. The inner and outer ring members 184*a*, 184*b* are centrally supported about the central core member 182 and spaced by means of axial end rings or sleeves 228 provided at the opposite ends. In this position, the various die members 188, punch members 190, and openings in each of the rings 184*a*, 184*b* are aligned with one another.

The cam track halves 232 are maintained in axial position relative to the rotatable cylindrical rings 184*a*, 184*b* by means of spacer blocks or rings 252 provided at the opposite ends, and the axial end sleeves 228 which are pin connected to the rotatable inner and outer ring members 184*a*, 184*b*. Mounted to these end block sleeves 228 are respective sleeve members 230 which are connected to an appropriate drive mechanism for rotating the inner and outer ring members 184*a*, 184*b* about the stationary central core 182, as best seen in FIG. 10. The bearings 227 are provided for permitting the end sleeve members 230 to rotate between the rear wall 224 and front support bar 226.

Figure 14:
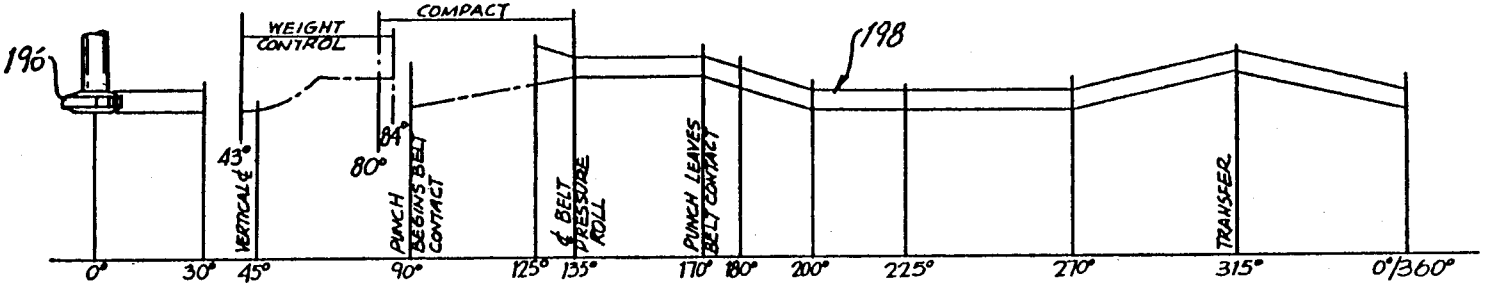
FIG. 14 is a schematic illustration of the movement of a punch member as the punch roll is rotated.

The specific pattern of movement of the punch members 190 in accordance with the present invention is shown in FIG. 14. When a punch member 190 is at the zero degree reference position, the punch member 190 and thus the die member 188 have just entered the supply hopper 160. The punch member 190 is in a fully retracted position, and thus a supply or charge of dry fill powder is received in the die chamber 180. The amount of material received is greater than the desired predetermined charge to be deposited in a pocket 26 in the web 24. At this lowest or most retracted position, the end of the punch head 194 is still within the die opening 180, i.e., the edge of the punch head 194 never clears the lower radially innermost edge of the die member 188.

The inner and outer ring members 184*a*, 184*b* continue to rotate and as the punch member 190 moves past the 30° position, the camming head 196 leaves the camming track 198 and engages the cam surface of the weight adjust cam member 200. At this position, the punch member 190 is still in a retracted position such that the quantity of fill powder within the die chamber 180 is greater than the amount of fill powder for the desired predetermined charge. As the punch roll 162 continues to rotate, the camming head 196 is forced upwardly by the cam surface of the weight adjustment cam member 200 until it reaches an approximate maximum extension which corresponds to a charge within the chamber 180 which is equivalent to the desired predetermined quantity of fill powder to be encapsulated. This occurs at approximately the 80°–84° position (see FIGS. 8 and 14). At about this position, as the inner and outer ring members 184*a*, 184*b* continue to rotate the flexible sealing member 172 on the hopper 160 serves to scrape the excess powder forced out of the chamber 180.

As the inner and outer ring members 184*a*, 184*b* continue to rotate, at about the 90° position, the open end of the die chamber 180 is closed by a belt member 260 which is trained about vertically spaced drive rollers 262. The belt member 260 has a width corresponding to the width of the punch roll 162. The belt member 260 follows the contour of the outer surface of the punch roll 162 for approximately 80° of rotation of the punch roll 162, i.e., to about the 170° position. The belt 260 serves to close completely the open ends of the die members 188 to ensure that the powder remains within the chambers 180. As the punch roll 162 rotates from the 90° position, the camming head 196 of the punch member 190 engages the compaction adjust cam member 202 and is forced radially outward to compact the dry fill powder within the chamber 180 against the surface of the belt 260. The maximum amount of compaction occurs at approximately the 135° position where a belt pressure roll 264 is provided. Depending on the position of the compaction adjust camming member 202 relative to the central core member 182, the degree of compaction can be precisely controlled.

At approximately the 135° position, the camming head again engages the camming track 198 and the punch member 190 retracts slightly as the die member leaves the belt 260 during continued rotation of the punch roll 162. The punch member 190 remains in the same radial position as the punch roll 162 continues to rotate until the punch member 190 approaches the transfer roll 166 which is located at approximately the 315° rotational position. During this rotation of the punch roll 162, the compacted slug 164 of dry fill powder remains at the entrance or edge of the die chamber 180 as a result of it having been tightly compacted thereat. In other words, after the dry powder has been compacted into a slug 164, the punch member 190 may be retracted slightly but the slug 164 remains in position at the die chamber 180 by virtue of its having been tightly compacted thereat.

At the transfer location, the camming track 198 guides the punch member 190 radially outward to cause the head 194 of the punch member 190 to engage the slug 164 and push the slug 164 from the die chamber 180 at precisely the 315° rotational position. At this position, the transfer roll 166, which has a series of recesses 266 on the surface thereof (see FIGS. 5, 19 and 20), has been rotated into position so that one of the recesses 266 is in alignment with the die chamber 180 to receive the compacted slug 164 ejected from the punch roll 162. As the punch roll 162 continues to rotate, the cam track 198 guides the punch member 190 toward a retracted position until the 360°/0° position is reached, and the cycle repeated to produce and transfer compacted slugs 164 of a precise predetermined quantity of dry fill powder.

Figure 19:
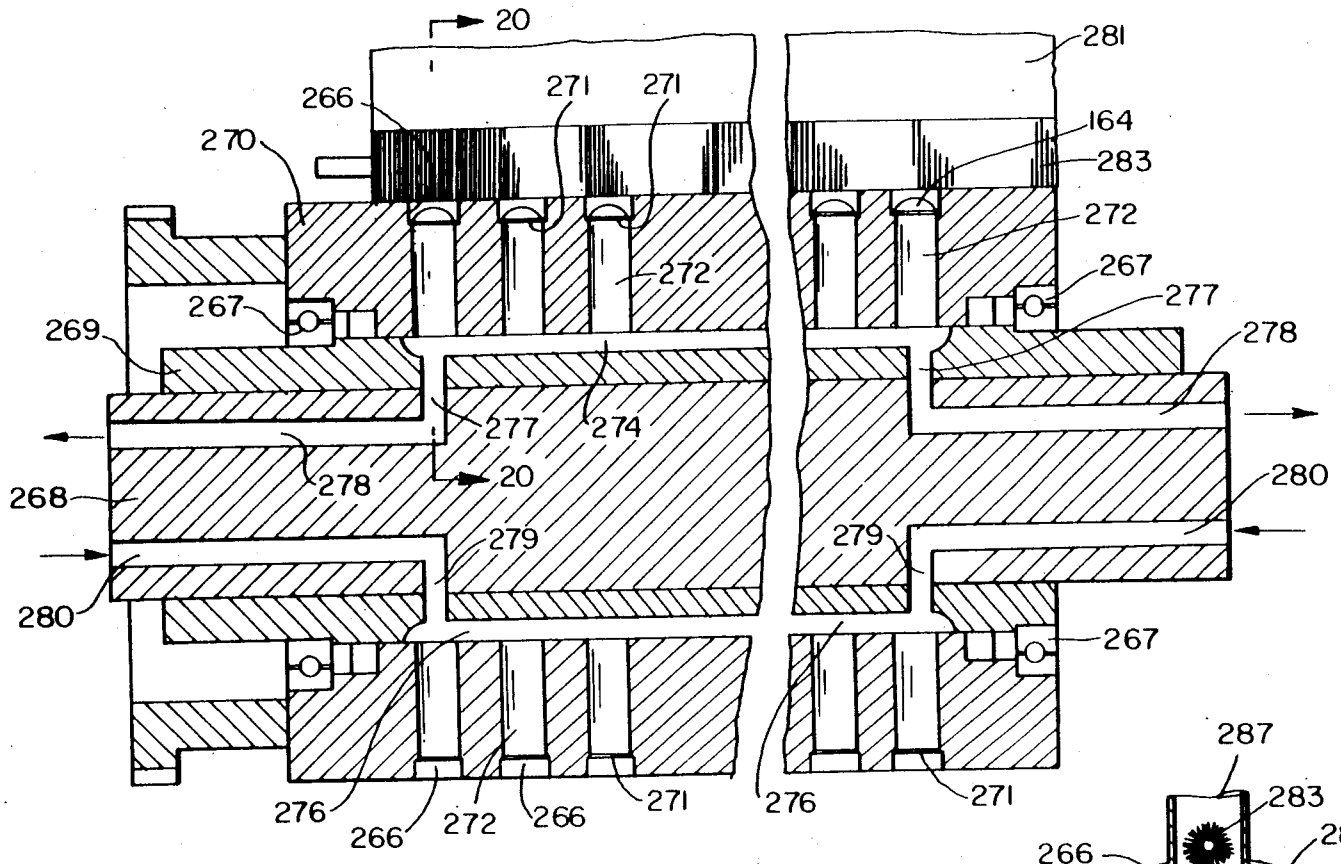
FIG. 19 is a side sectional view of the transfer roll.
Figure 20:
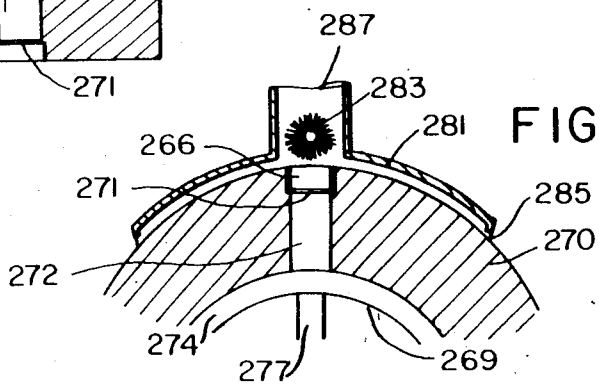
FIG. 20 is an end sectional view of a portion of the transfer roll taken along the lines 20—20 of FIG. 19.

The transfer roll 166, best seen in FIGS. 5, 19 and 20, includes a stationary central core member 268 having a fixed stationary sleeve 269 and a rotatable annular sleeve member 270 mounted thereon, the rotatable sleeve member 270 having the series of cavities or recesses 266 on the surface thereof. The rotatable annular sleeve member 270 is supported for rotation by means of bearings 267 provided between the stationary sleeve 269 and the rotatable sleeve 270 at the opposite ends of the transfer roll 166. Radially extending passageways 272 are provided in the rotatable sleeve 270 in communication with each cavity or recess 266 for providing communication with the inner cylindrical surface of the sleeve 270. A screen member 271 is provided in the bottom of the recesses 266 at the outer ends of the passageways 272. Portions of the outer surface of the stationary sleeve 269 have been cut away or recessed to provide a pair of circumferential recesses 274, 276 between the rotatable sleeve 270 and the stationary sleeve 269. As best seen in FIG. 5, one of the circumferential recesses 274 extends approximately 270° about the circumference of the stationary sleeve 269. As best seen in FIG. 19, there is provided a pair of ports 277 at the end of the stationary sleeve 269 which each communicate with the circumferential recess 274 and with ports 278 provided in the stationary core 268. The ports 278 in turn extend axially from the stationary core 268 and are connected to a source of vacuum or reduced air pressure. The other circumferential recess 276 extends circumferentially only approximately 15°, and is connected by via ports 279 and 280 with a source of pressurized air. The smaller recess 276 is directly vertically aligned with the axis of a sealing roll 32.

The transfer roll 166, which in the preferred embodiment is of a smaller dimension than the punch roll 162, is rotated at an appropriate speed so that the series of cavities or recesses 266 provided in the surface thereof are timed to be in juxtaposition with the die chambers 180 on the punch roll 162 so as to receive compacted slugs 164 at the transfer point when the punch members 190 force the slugs 164 radially outward from the punch roll 162. At the approximate transfer position for the transfer of compacted slugs 164 from the punch roll 162 to the transfer roll 166, it will be seen from FIG. 5 that the passageway 272 for the recess 266 in the transfer roll 166 in juxtaposition with the die chamber 180 in the punch roll 162 is in communication with the large circumferential recess 274 which in turn communicates with a source of vacuum or reduced pressure so that the compacted slug 164 is pulled or sucked from the punch roll 162 into the recess 266 in the transfer roll 166 to rest against the screen 271. By virtue of the passageway 272 being connected to the source of vacuum, the slugs are "popped" out of the punch roll 162 and into position against the screen 271 in the recesses 266 of the transfer roll 166. it will be noted that the recesses 266 in the transfer roll 166 are of a size greater than the size of the slugs 164.

As the sleeve member 270 of the transfer roll 166 continues to rotate about the core member 268, the passageway 272 having the slug 164 therein remains in communication with the source of vacuum until the passageway 274 moves past the raised surface 282 and then into communication with the smaller circumferential passageway 276 which is connected to the source of pressurized air. At this location, the slug 164 is transferred into the cavity or pocket 26 formed in the gelatin web 24 which is being moved by rotation of the sealing roll 32. The pressurized air in essence serves to "spit" the slug 164 out of the recess 266 in the transfer roll 166 into a cavity or pocket 26.

It will be noticed from FIG. 5 that the direction of rotation of the sealing roll 32 corresponds to and is the same direction of rotation as the transfer roll 166 (i.e., the surfaces of the sealing and transfer rolls 32, 166 move in opposite directions at the nip thereof), and thus a small or slight clearance is provided between the two rolls 32, 166 to prevent rubbing therebetween. The timing of rotation is such that the recesses 266 in the transfer roll 166 are moved into position and a slug 164 ejected from the transfer roll 166 as each new circumferential cavity or pocket 26 is moved into position in alignment with the transfer roll 166. In other words, the compacted slugs 164 are delivered by the transfer roll 166 at a rate equivalent to the rate that the cavities or pockets 26 in the web 24 move past the transfer roll 166. By appropriately choosing the speeds of rotation for the transfer roll 166, the punch roll 162 and the sealing roll 32, as well as the dimensions, and in addition, the number of locations provided on the circumference of the transfer roll 166, punch roll 162 and sealing roll 32, it is possible to coordinate the various rolls such that a compacted slug 164 is delivered to each cavity or pocket 26 as the cavity or pocket 26 is moved past the transfer roll 166.

In this regard, in the preferred embodiment, the diameters of the sealing rolls 32 and punch rolls 162 are each ten inches, whereas the diameter of the transfer rolls 166 is five inches. On the surface of the sealing roll 32, there are provided 96 rows 134 of equally spaced recesses 50—48 rows 134A of A series and 48 rows 134B of B series. There are four stations evenly spaced about the circumference on the punch roll 162 at each axial location for the A series of pockets 26 and four stations evenly spaced about the circumference at each axial location for the B series of pockets 26. As the B series of pockets 26 are provided intermediate each row of A series of pockets 26 on the web 24, the stations for the B series are circumferentially spaced between the stations for the A series, i.e., 45° from each A station (see FIG. 11). The punch roll 162 must thus be rotated at twelve times the speed of the sealing roll 32. The transfer roll 166 has two stations at each axial location for the A series of pockets 26 and two stations at each axial location for the B series of pockets 26. The reason for this is that the transfer roll is five inches in diameter and thus is one half the size of the punch roll 162. Accordingly, by providing two stations, the circumferential distance between stations on the transfer roll 166 will be equal to the circumferential distance between stations on the punch roll 162. In order to maintain alignment of the recesses 266 in the transfer roll 166 with the die chambers 180 in the punch roll 162, the transfer roll is rotated twice as fast as the punch roll, and thus twenty-four times the speed that the sealing roll rotates.

In order to insure that the outer surface of the transfer roll 166 remains substantially clean and free of any dust or loose power material, as best seen in FIGS. 5 and 20, there is provided a shroud 281 extending over a portion of the outer surface of the transfer roll 166. The outer circumferential edges of the shroud 281 are arranged in closely spaced relationship to the outer surface of the transfer roll 166 in a manner so as to provide a small axially extending slot 285 between the outer edges of the shroud 281 and transfer roll 166 for air intake into the shroud 281, while not interfering with rotation of the transfer roll 166. A longitudinally extending brush member 283 is provided within the shroud 281 which extends along the longitudinal or axial length of the transfer roll 166. The brush 283 is mounted so that the outer edges thereof are arranged closely to the surface of the transfer roll 166 but without touching such surface. The interior of the shroud 281 is connected through a duct 287 to a suitable source of vacuum so as to pull air thereinto through the slot 283 provided between the outer circumferential edges of the shroud 281 and the surface of the roll 166 upwardly and through the duct 283. The brush 283 is rotated at a high speed so as to create a turbulence along a portion of the outer surface of the transfer roll 166 as it moves therepast to thereby provide a rush of air to sweep the surface of the roll 166 clean. This action also serves to sweep clean the outer surface of the compacted slug 164 in the recess 266. In this regard, it is important to note that the brush 283 does not actually contact the transfer roll 166 but simply is rotated at a high speed to create a turbulence so that any loose dust or powder material on the surface of the roll 166 is cleaned therefrom. Similarly, the source of vacuum communicating via the passageways 272 serves to clean the underside of the slug 164 against the screen 271 and the interior of the cavities or recesses 266 so as to insure that the slugs 164 will be substantially clean and free of any dust or uncompacted powder material when they are delivered to the sealing rolls 32. Here it should be noted that the vacuum or reduced pressure within the interior of the shroud 281 is less than the vacuum communicating with the recesses 266 via the passageways 273 so that the slugs 164 will remain in position against the screen 271 provided therein. Suitable collection devices (not shown) are provided externally of the transfer roll 166 and shroud 281 for collecting and removing the dust or loose material which is swept away from the slugs 164 and cavities 266.

Between the pair of rotatable sleeve members 184*a*, 184*b*, it will be noted that an annular space 254 is provided. This annular space 254 also communicates with each of the chambers 180 around the punch heads 94. The annular space 254 is connected with a suitable source of air pressure provided through an air passageway 256 in one end of the central core member 182 which thus provides a cooling effect on each of the chambers 180, as well as for keeping excess powder or dust which might be created from contaminating the entire apparatus 20 so that the punch members 190 are maintained clean and in good working order.

As has been noted hereinabove, it is most important to prevent any excess powder or dust from dropping onto the gelatin webs 24 about the cavities 26 formed therein, as such excess powder or dust would otherwise prevent the making of good seals as the webs 24 pass through the nip of the sealing rolls 32. The chances of free uncompacted powder or dust being deposited on the webs 24 is minimized in accordance with the present invention by virtue of a number of features. More specifically, the powder supply hopper 170 containing the powdered material to be placed in the capsules 22 is positioned remotely from the path along which the capsule forming material or gelatin web 24 is fed. In addition, in accordance with the present invention, a predetermined charge of powder material is initially loaded and compacted in the punch roll 162 to form a compacted slug 164. Thus, the possibility of free excess dust of powder material being deposited or finding its way onto the web 24 of cavity forming material is minimized since the loading and compacting operations take place at a remote location to the web 24 by virtue of the punch roll being spacedly positioned from the web 24. Furthermore, when the powdered material is eventually transferred into the cavities or pockets 26 in the gelatin web 24, it is in the form of a compacted slug 164. Still further, the transfer of the compacted slug 164 to the cavity 26 in the web 24 of capsule forming material is accomplished with a transfer roll 166 which also serves to minimize the possibility of dust or powder material collecting on the web 24 of capsule forming material. More particularly, the initial transfer from the punch roll 162 to the recess 266 in the transfer roll 166 is at a position remote from the web 24, with the transfer roll 166 then being rotated into position so as to deposit the compacted slug 164 into the cavity 26 of the web 24 of capsule forming material. Additionally, a vacuum or reduced air pressure is provided in the transfer roll 166 in communication with the recesses 266 in the transfer roll 166 to suck and collect any excess, free and uncompacted powdered material which may be transferred with the compacted slug 164. In this manner, a virtually clean, powder free compacted slug 164 will be delivered to the position for transfer and deposit into the cavity 26 in the web 24. Still further, the surface of the transfer roll 166 is continuously cleaned of dust and free powder material after receiving the compacted slug 164 before a compacted slug 164 is delivered into a cavity 26 in the web 24 of capsule forming material. Still further, the punch roll 162 itself is continuously cleaned of excess powder material or dust by virtue of the air passageway 52, 56 in the center thereof for continuously cleaning the chambers 180 in the punch roll 162. Therefore, it will be appreciated that numerous safeguards are provided in accordance with the present invention for insuring that free, uncompacted powder material and dust will not be deposited on the web 24 and instead, only substantially clean, powder free slugs 164 of fill material will only be placed into the cavities 26 formed therein. Consequently, when the gelatin material or web 24 having the compacted slugs 164 therein is moved into the nip between the sealing rolls 32, a good efficient seal will be formed therein such that the formed capsules 22 will not have a tendency to break open.

Figure 15:
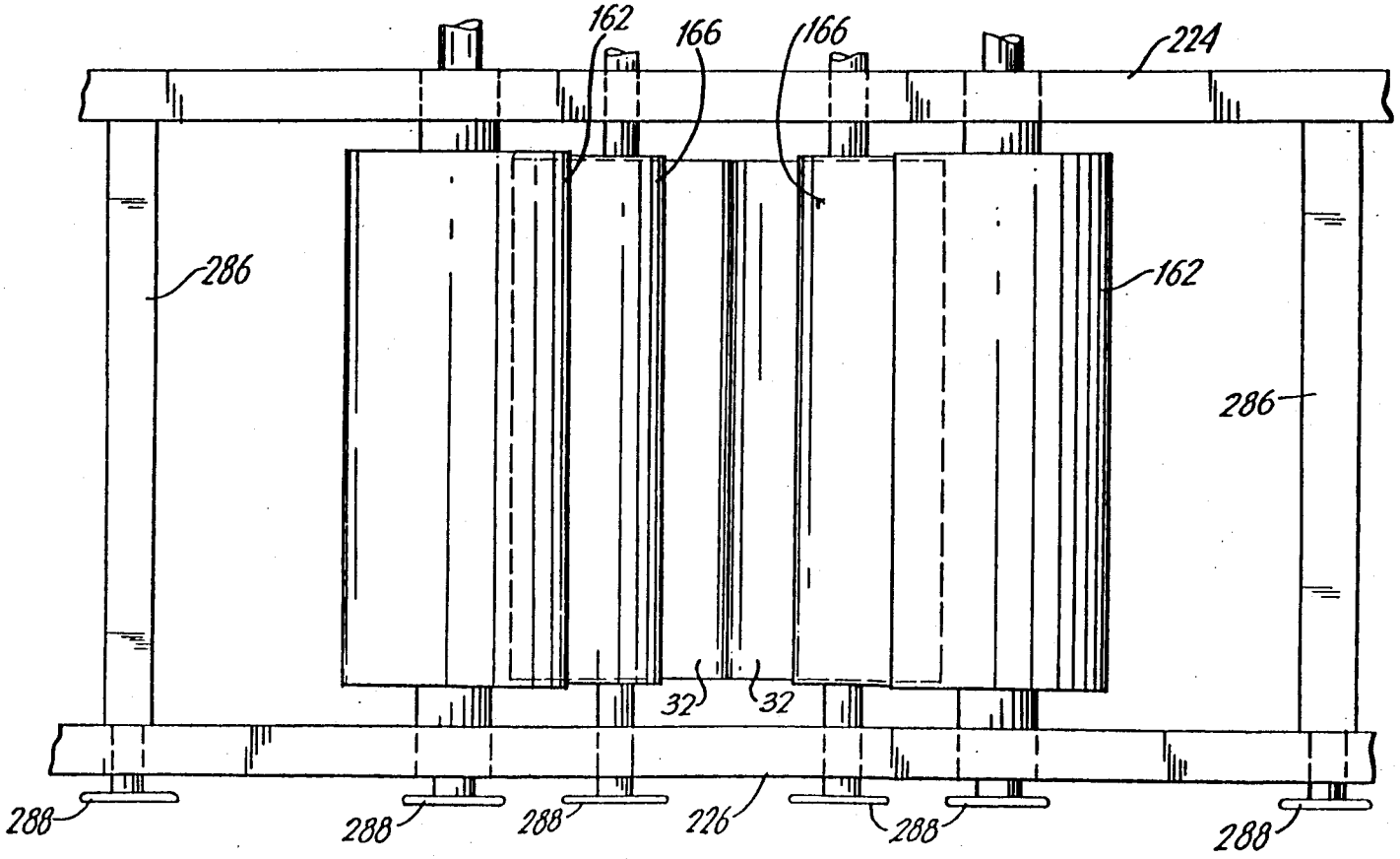
FIG. 15 is a top plan view of the central portion of the apparatus shown in FIG. 1, illustrating the punch and transfer rolls with the wedge and cavities in the rolls being deleted for clarity.

The rear ends of the sealing rolls 32 and transfer rolls 166, as well as the punch rolls 162, are all supported in the relatively substantial rear wall member 224. Also extending from the rear wall 224, as best seen in FIG. 15, are a plurality of locking bars 286 arranged on the opposite lateral sides of the rolls 32, 162, 166 which serves to mount the forward support bar 226 which supports the forward ends of the punch and transfer rolls 162, 166. A second forward support bar (not shown), located at a lower elevation is provided for supporting the forward ends of the sealing rolls 32. At each of the forward ends of the locking bars 286 as well as at the forward ends of the punch rolls 162, transfer rolls 166 and sealing rolls 32, there is provided with hand wheels 288 for tightening of the locking bars 286 and various rolls to thereby maintain a fixed desired axial positioning of the various rolls with respect to one another.

Figure 16:
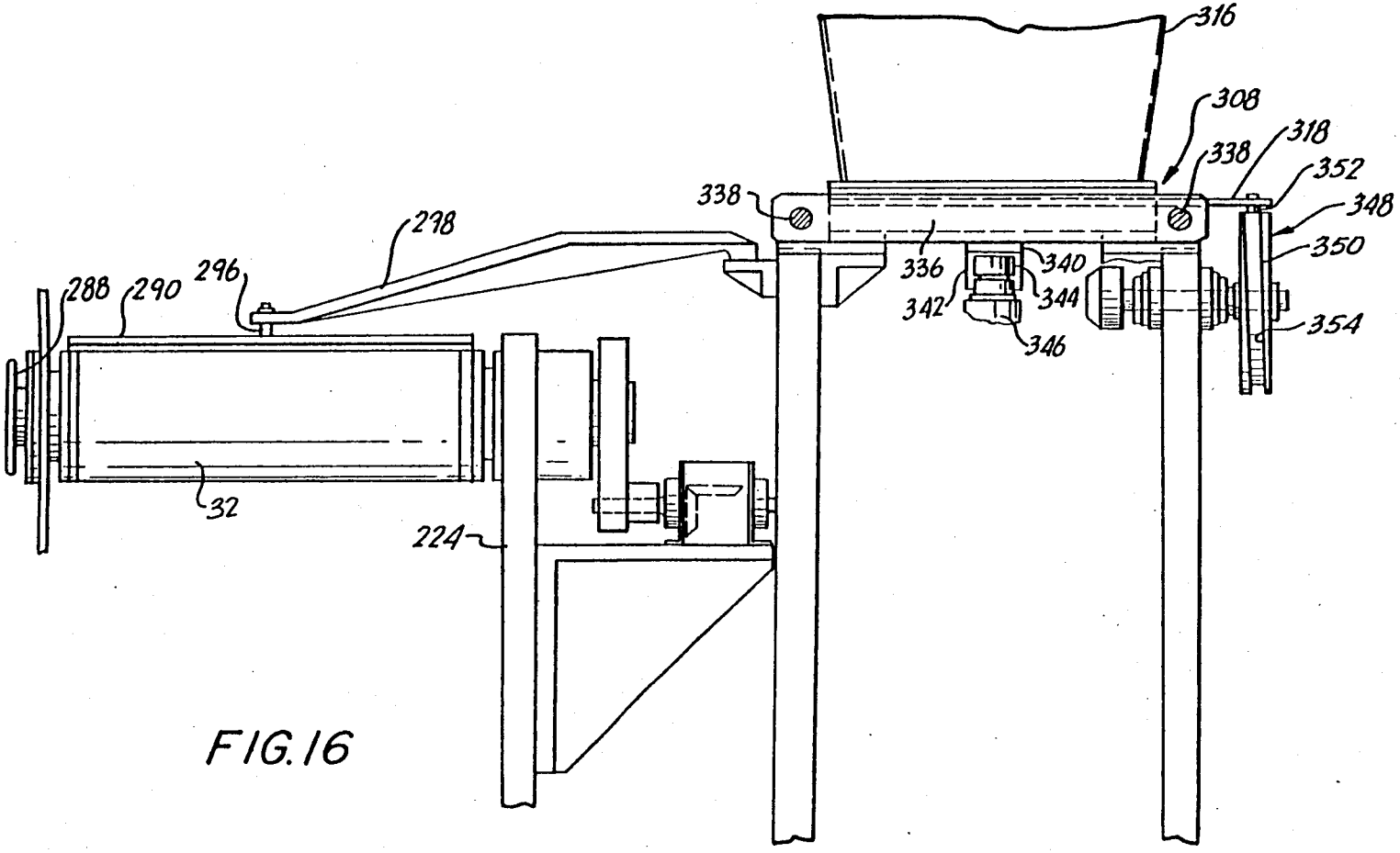
FIG. 16 is a schematic side elevational view of the sealing rolls and illustrating the pumping mechanism for depositing liquid fill material into cavities in gelatin webs.

The apparatus 36 for filling the pockets 26 in the webs 24 with liquid fill material utilizes a wedge-shaped head 290 which is supported between the pair of sealing rolls 32 adjacent the nip thereof, as can best be seen in FIGS. 5 and 6. More particularly, the wedge member 290 extends longitudinally across the width of the sealing rolls 32 and has a generally triangular cross-sectional shape which includes a pair of generally concavely shaped surfaces 292 which are complimentary to the circumferential surfaces of each of the sealing rolls 32. The concavely shaped surfaces 292 of the wedge member 290 converge toward a tip 294 which is adapted to be arranged adjacent to the nip between the pair of sealing rolls 32. The wedge member 290 is suitably supported above the pair of sealing rolls 32 by means of pairs of support bars 296, 298. More particularly, one end of each of the vertically extending bars 296 is arranged above the longitudinal center of the wedge member 290 and is received within recessed openings in the upper surface of the wedge member and retained thereinplace. As best seen in FIG. 16, the opposite ends of the bars 296 are supported by rearwardly extending bars 298 which in turn are supported from the main support frame for the liquid pump (to be described in more detail hereinbelow). The wedge member 290 is thus designed to "float" on each of the gelatin webs 24 as they are moved towards the nip between the pair of sealing rolls 32.

The shaped member 290 includes a plurality of water passageways 300 therethrough through which heated water may be passed to heat the gelatin webs 24 just prior to the webs 24 being moved into the nip between the sealing rolls 32. For example, it is generally preferred to maintain the wedge member 290 at approximately 92° to 105° F. which will serve to sufficiently heat the gelatin webs 24 to an appropriate temperature at which a good and efficient seal will be made as the webs 24 pass through the nip of the sealing rolls 32 and the shoulders or lands 51 surrounding the recesses 50 on the surface of the sealing rolls 32 press the webs 24 together around each pocket 26.

For filling the cavities or pockets 26 in the webs 24 with a liquid fill material, the wedge member 290 includes a series of passageways 302 provided along the longitudinal length thereof which extend downwardly toward the tip 294. The lower end of each passageway 302 is connected to a "T" passageway 304 which has open ends 306 which communicate with each of the concave surfaces 292 at positions just above the nip of the sealing rolls 32 for injecting a liquid fill material into the cavities or pockets 26 as they pass the open ends 306 of the "T" passageway 304. In this regard, it will be noted from FIG. 6 that the concave surfaces 292 of the wedge member 290 at the location of the open ends 306 of the "T" passageway 304, and toward the tip 294 of the wedge member 290 precisely conform to the cylindrical surfaces of the sealing rolls 32 so as to effectively seal against the outer surface of the gelatin webs 24 as the webs 24 move therepast. This is important in order to retain the liquid fill material in the pockets 26 as they progress toward the nip and thus prevent the loss or spillage of liquid. That is, in essence, the only open area for the liquid is in the cavities or pockets 26 formed in the surface of the webs 24. The tip 294 of the wedge member 290 terminates just above the nip so that as the respective webs 24 each leave contact with the wedge member 290, they are immediately brought into contact with one another and sealed.

The number and the location of the liquid passageways 302 and corresponding "T" passageways 304 provided in the wedge member 29 are the same as the number and locations of the pockets 26 in each pair of adjacent rows of pockets 26 in the webs 24. That is, as with the punch roll 162, the passageways 302, 304 are aligned with the centerline of each of the pockets 26 in a row of A series pockets and in a row of B series pockets. Thus, it will be appreciated that every other passageway 302 along the length of the wedge member 290 will serve to provide liquid fill material through its corresponding "T" passageway 304 into the pockets 26 of an A series row, and the alternate pockets of passageways 302, 304 will serve to provide liquid into the B series row. In order to alternately pump liquid fill material through the alternate passageways 303, 304, since at any given time only one row of pockets 26 will be in position to be filled, a Scotch yoke type pumping apparatus 308 is utilized. More particularly, the Scotch yoke type pump apparatus 308 is a reciprocating pump which during one stroke serves to charge half of the passageways 302, 304, for example passageways 302, 304 serving the B series of pockets 26 in the webs 24, and during the reciprocating stroke, serves to charge the remaining passageways 302, 304, for example the passageways 302, 304 for the A series of pockets 26.

Figure 17:
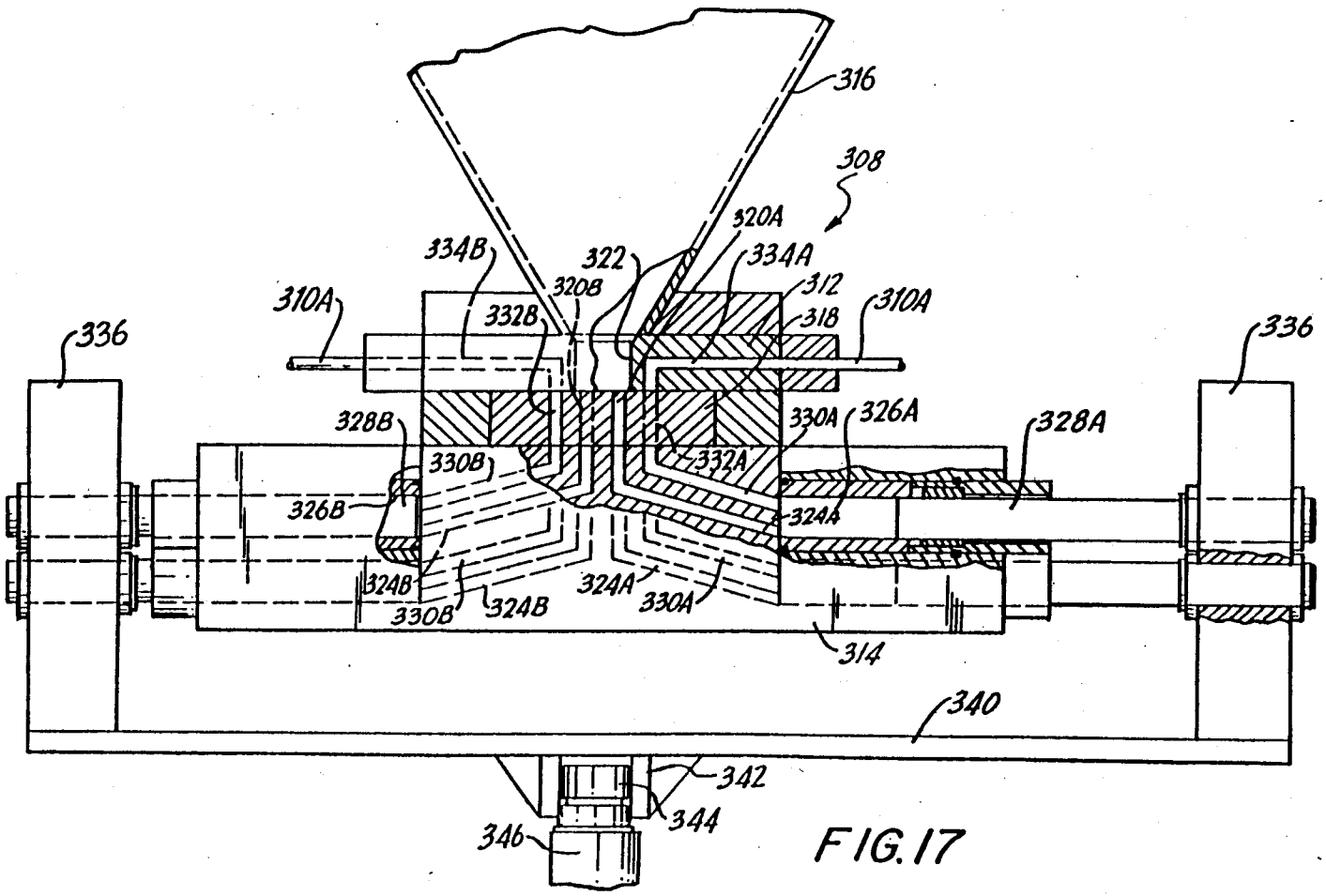
FIG. 17 is a schematic end sectional view of the pumping apparatus.

As best seen in FIG. 17, the pump 308 includes a central hopper 316 filled with an appropriate liquid fill material which is to be encapsulated. The hopper 316 is supported on a distribution manifold 312 which is located above the main pump body 314. The hopper 316 is open at its bottom end and communicates with a central opening 322 in the distribution manifold 312. A slide valve 318 is slidably supported in a recess provided between the distribution manifold 312 and the main pump body 314 and is adapted to reciprocate therein. The slide valve 318 has a series of passageways 320 therethrough which communicate with a central opening 322 in the distribution manifold 312 so as to receive liquid fill material from the hopper 316. The main pump body 314 likewise has a plurality of passageways 324 therein which lead from beneath the slide valve 318 to corresponding pump chambers 326 located on opposite sides of the pump body 314 along the length of the pump body. A plurality of pistons 328 are provided in the chambers 326 for reciprocating movement therewithin. The number of pump chambers 326A and pistons 328A along one side of the pump body 314 correspond to the number of recesses 50A in each A series row 134A of recesses 50 of the sealing roll 32, whereas the number of pump chambers 326B and pistons 328B along the other side of the pump body 314 correspond to the number of recesses 50B in each B series row 134B of recesses 50. For space economy, the chambers 326 and piston 328 on each side of the pump body 314 are arranged in two rows, one above the other.

As the slide valve 318 reciprocates, the passageways 320 in the slide valve 318 are adapted to alternately communicate with the passageways 324 in the main pump body 314 to alternately fill the chambers 326 first on one side of the pump body 314 and then on the other side of the pump body 314. That is, when the slide valve 318 is at one end of its stroke, the passageways 320A are aligned with the passageways 324A which serve the chambers 326A on one side of the pump body 314 and the passageways 324B are blocked. When the slide valve 318 is at the other end of its stroke, the passageways 320B thereof are aligned with the passageways 324B which serve the pump chambers 326B on the other side of the pump body 314, and the passageways 324A are closed.

A second series of passageways 330 are provided in the pump body 314 in communication with the pump chambers 326, and a second series of passageways 332 are provided in the slide valve 318 for alternate communication with the passageways 330 as the slide valve 318 reciprocates. In the distribution manifold 312, there is also provided a series of passageways 334 which are open on the opposite sides of the manifold 312. Flexible conduits 310 are connected at one end to these passageways 334 in the manifold 312 and at their other ends to the passageways 302 in the wedge member 290. More particulary, the passageways 334A on one side of the manifold 312 serve the passageways 302 which are aligned with the pockets 26 in an A series row, and the passageways 334B on the other side of the manifold 314 serve the passageways 302 which are aligned with the pockets 26 in a B series row.

The passageways 332 in the slide valve 318 are arranged so that they provide communication between the pump chambers 326 and passageways 334 on one side of the pump body 314 when the chambers 326 on the other side of the pump body 314 are in communication with the hopper 316 through the opening 322 and passageways 320. That is, when the passageways 320B of the slide valve 318 are aligned with the passageways 324B, the passageways 332A are aligned with the passageways 320A and 334B, and similarly, when the passageways 320A are aligned with the passageways 324A, the passageways 332B are in communication with the passageways 330B and 334B.

The series of pistons 328 provided in each of the chambers 326 on opposite sides of the pump body 314 are interconnected to one another by appropriate means on each side of the pump body 314 so that as the pistons 328A on one side of the pump body 314 move towards the center of the pump body 314, the pistons 328B on the other side will move away from the center of the piston body 314, and vice versa. Movement of the piston rods 328 and the slide valve 318 are timed and synchronized so that as the piston rods 328 retract in their respective chambers 326, the chambers 326 are in communication with the hopper 316 and liquid is thus drawn from the liquid hopper 316 into the respective chambers 326. Similarly, as the pistons 328 move toward the center of the piston body 314, the chambers 326 are in communication with the flexible conduits 310 so that the liquid in the respective chambers 326 is pumped into the passageways 302 in the wedge member 290. Thus, it will be appreciated that during the reciprocating movement of the pistons 328, liquid from the liquid hopper 316 is being supplied into the chambers 326A corresponding to one row of pockets 26 in the sealing roll 32, for example the A series, while in the chambers 326B for the adjacent row of pockets 26, i.e., the B series, the liquid is being pumped into the corresponding passageways 302 in the wedge member 290, thereby resulting in the B series of pockets 26 being filled with liquid. Upon the reciprocating stroke the reverse takes place, i.e., a row of A series pockets 26 is charged with liquid fill material and the chambers 326B for a row of B series pockets are filled with liquid.

It should be noted in this regard that during the chamber fill stroke, the liquid in the corresponding passageways 302, 304 in the wedge member 290 and in the flexible lines 310 remains in the flexible lines 310 and passageway 302, 304, and is not discharged therefrom. In other words, because liquid is always in the various lines 310 and passageways 302, 304, when one set of pistons 328 is retracted to draw more liquid from the hopper 316 into the respective chambers 326, the liquid already in the corresponding flow lines 310 and passageways 302, 304 will not flow out thereof and spill onto the gelatin webs. Conversely, during the chamber discharge stroke, the liquid in the chamber 326 is forced or pumped into the corresponding flexible lines 310 in communication with the corresponding passageways 302, 304 in the wedge member 290, thereby causing a portion of the liquid fill material therein to be forced or discharged through the passageway 304 into the pockets 26 in the pair of webs 24 on the sealing rolls 32. Also, it will be appreciated that each of the various pockets 26 in respective rows extending across the width of the sealing rolls 32 will be filled simultaneously by the supply of liquid to each of the passageways 302, 304 in the wedge member 290 in alignment therewith.

Figure 18:
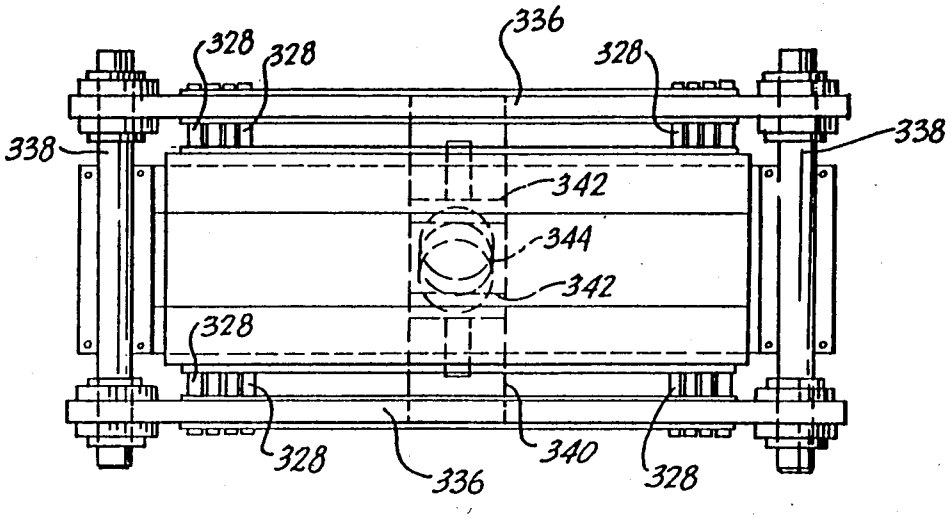
FIG. 18 is a plan view of the pumping apparatus.

In the preferred embodiment, the main pump body 314 remains stationary during operation, and only the piston rods 328 are moved. More particularly, the ends of the pistons 328 on each side of the pump body 314 are supported in respective piston bars 336, and the piston bars 336 on each side of the pump body 314 are connected together at the ends by tie rods 338 (see FIG. 18). Beneath the pump body 314 and centrally located, an additional tie bar or plate 340 is connected to the pair of piston plates 336. The central tie plate 340 has secured to its lower surface a pair of vertically extending brackets or plates 342 which are spaced from one another and parallel to the bars 336. Between the pair of plates 342, there is provided a rotatable cam disc 344 which has an eccentrically arranged shaft 346 extending downwardly therefrom.

Because the shaft 346 is eccentric to the axis of the cam disc 344, rotation of the shaft 346 causes the plate members 342 to move back and forth to in turn cause the piston bars 336 to move toward and away from the pump body 314.

A barrel cam apparatus 348 is provided for moving the slide valve 318 in timed relationship to the movement of the pistons 328. The barrel cam arrangement includes a rotatable cam disc 350 having a circumferential groove 354 on which a camming pin 352 affixed to an extension of the slide valve 318 rides. The groove 354 is shaped so that as the disc 350 rotates, the pin 352 and thus the slide valve 318 reciprocates back and forth.

The disc 350 and the shaft 346 are both suitably connected to the main drive for the apparatus 20 so that they are timed and synchronized in the manner described above and operate in unison with the sealing rolls 32 so that as each new row of pockets 26 in the webs 24 are brought into alignment with the open ends 306 of the respective "T" passageways 304 in the wedge member 290, the direction of piston movement is changed in order to inject liquid fill material into the pockets 26 of the new row. In this regard, the movement of the pistons 328 is timed so that the discharge of liquid in the passageways 302, 304 is started when the leading edge of a pocket 26 first reaches the open end 306 in the wedge member 290 and the discharge stopped when the trailing edge of the pocket 26 leaves the open end 306 in the wedge member 290.

In some instances, the number of pockets 26 in a row to be filled will be less than the maximum number corresponding to that which the Scotch yoke pump 308 may handle. For example, if the pump 308 is designed to handle thirty-three pockets 26 per each row of A series and thirty-two pockets 26 for each row of the B series, but the webs 24 are only sized to provide twenty cavities and nineteen cavities, respectively, per row for the A and B series, then a selector plate 260 may be utilized which serves to block the passageways 302 which are not to be used (i.e., those passageways 302 for which pockets 26 are not provided in the webs 24). The selector plate 360 is located in the wedge member 290 serves to direct the liquid from the pump chambers 326 and flexible lines 310 into a common return line (not shown) which serves to return liquid therein back to the liquid hopper 316. The selector plate 360 is desired as it ensures that the liquid in the various lines and chambers is being continuously pumped at all times—i.e., either introduced into a pocket 26 on the web 24 or simply returned back to the hopper 316. This is most important especially if solid particles are suspended in the liquid to be encapsulated as otherwise jamming or clogging of the passageways might result.

As can best be seen in FIG. 6, the concave surfaces 292 of the wedge member 290 each include a recessed area 370 along a portion thereof intermediate the tip 294 and the outer side edge 372 thereof. The non-recessed portions adjacent the tip 294 and outer side edge 372 comprise edge sealing surfaces which are adapted to seal against the webs 24 as the webs 24 are moved past the wedge member 290. Suitable sealing surfaces are also provided at the longitudinal ends of the wedge member 290 so that the volume defined between each recessed surface 370 and the surface of the web 24 is sealed from the surrounding atmosphere. The recessed surfaces 370 in each concave surfaces 292 extend longitudinally to the opposite edges of the web 24, and laterally from a point generally near the edge that the web 24 first engages the wedge member 290 downwards toward the nip approximately 30°. A series of first and second passageways 374, 376 are provided in communication with this recessed area 370 along the length of each concave surface 292. The first series of passageways 374 are connected to a suitable source of vacuum or reduced air pressure, and the second series of passageways 376 are connected to a suitable source of inert gas, such as for example nitrogen or carbon dioxide. As the numerous pockets 26 formed in the surface of the webs 24 move beneath the recessed areas 370, the air entrapped therein is evacuated through the first passageways 374 and an inert gas substituted therefor through the second passageways 376 so as to provide substantially deaerated pockets or cavities 26 in the webs 24. This deaeration is most important with many types of fill material to be encapsulated which may be subject to oxidation or other deterioration in the presence of air. For example, fill materials comprising flour, eggs, butter, and certain types of oils, as well as other materials may become rancid or deteriorate if encased in the presence of air or other oxidizing chemicals. With the arrangement of the wedge member 290 and the first and second passageways 374, 376, the air may be evacuated from the pockets 26 in the webs 24 and an inert gas, e.g., with a gas which is devoid of oxygen which might otherwise affect the stability of the product, substituted therefor. This thus allows for a greater variety of materials to be encapsulated.

It should be noted that the wedge member 290 may be utilized for the evacuation of air and the introduction of inert gas and may be utilized with respect to either solid fill materials or liquid fill materials, or both. For solid fill materials which are to be encapsulated, the compacted slugs 164 are deposited in the pockets 26 of the webs 24 prior to the pockets 26 being evacuated and an inert gas introduced. For liquid fill materials, the evacuation of air and substitution of an inert gas therefor is accomplished prior to the introduction of liquid fill material into the pockets 26. Also, although in FIG. 6 the first passageways 374 are shown to be furthest from the nip and the second passageways 376 closest to the nip, the passageways 374, 376 could be reversed, i.e., the air evacuated through the passageways 376 closest to the nip and the inert gas introduced via the passageways 374 furthest from the nip.

Thus, with the wedge member 290 and the pumping apparatus 308 in accordance with the present invention, it is possible to deposit liquid fill material to be encapsulated into each of the pockets 26 in the webs 24 as the webs pass about the sealing rolls 32. Additionally, with the wedge member 290, the formed capsules 22 may be deaerated of oxidizing agents, i.e., air may be replaced with an inert gas which will not result in deterioration of the fill materials. Further in this regard, the wedge member 290 may be used either alone (i.e., if only liquid fill material is to be encapsulated) or in combination with the fill powder apparatus (i.e., if fill powder is to be encapsulated, either with or without a liquid fill material).

After the webs 24 have passed between the nip of the sealing rolls 32 and the two capsule halves have been sealed to form a completed capsule 22, the capsules drop into and are collected in troughs 154 positioned below the sealing rolls 32. The troughs 154 contain a cold solvent which serves to wash the oil from the capsules and to sweep the capsules away to a suitable drying station. A pair of flippers members or strippers in the nature of rotatable paddles 156 are also provided which rotate and serve to extract the capsules which might hang from the remaining net of web material. Each of the paddles 156 comprises a rotatable shaft having rubber flippers therein which serve to gently knock the netting of web material. In this regard, it is to be noted that the capsules 22 as they exit from the sealing rolls 32 are still quite warm and are subject to deformation if struck too harshly. When the capsules 22 fall in the cold solvent, the solvent also serves to cool the capsules 22 to further solidify same. In this regard, it will be noted that the troughs 154 include upwardly extending guide plates 155 are provided on opposite sides of the troughs 154 to ensure that the capsules 22 extracted from the webs 24 are directed into the troughs 154.

Also, beneath the sealing rolls 32, there are provided rotatable nylon brushes 380 which serve to strip or remove any capsules which might have been stuck or retained in the recesses 50 of the sealing rolls 32. Further, the netting or remaining portion of the gelatin webs 24 pass between the inner pair of guide plates 155 extending on either side of the solvent troughs 154 through a pair of rollers 382 which serve to hold the netting tightly and pull it downwardly to prevent it from jamming between the sealing rolls 32 and the solvent troughs 154. The gelatin netting may then be guided to an appropriate apparatus for chopping the netting up into small pieces which may then be soaked with cold solvent to remove the oil and then collected for recycling.

While the preferred embodiments of the present invention has been shown and described, it will be understood that such are merely illustrative and that changes may be made without departing from the scope of the invention as claimed.

What is claimed is:

1. Apparatus for making capsules comprising:

feeding means for feeding capsule forming material having a series of cavities formed therein along a predetermined path of movement, said capsule forming material forming a portion of the casing of the capsules;

sealing means arranged along said predetermined path for sealing said cavities;

depositing means arranged along said predetermined path for depositing a material in said cavities of said capsule forming material, said depositing means being arranged upstream of said sealing means; and air displacing means arranged upstream of said sealing means for displacing air from said cavities and substituting therefor an inert gas prior to said cavities being sealed by said sealing means so that substantially deaerated capsules are formed, said air displacing means comprising an evacuation member having an evacuation surface disposed to face said cavities in said capsule forming material, said evacuation surface having a recessed portion and edge sealing means there-around for sealing against said capsule forming material as said capsule forming material is moved past said evacuation member to form a substantially airtight seal between said evacuation member and said capsule forming material, said evacuation member including first and second flow communication means communicating with said recessed portion of said evacuation surface, said first flow communication means communicating with a source of vacuum for withdrawing air from between the surface of said capsule forming material and said evacuation surface and said second flow communication means communicating with a source of inert gas for introducing an inert gas between the surface of said capsule forming material and said evacuation surface, said first and second flow communication means communicating with said recessed portion of said evacuation surface at spaced locations so as to provide a continuous sweeping of air from said cavities and replacement thereof with said inert gas as said capsule forming material is moved past said evacuation member.

2. The apparatus of claim 1 wherein said capsule forming material comprises a pair of webs of capsule forming material having a series of cavities therein; wherein said feeding means comprises web feed means for feeding said webs along converging paths so that said cavities in one of said webs are brought into juxtaposition with said cavities in the other of said webs; and wherein said sealing means seals said webs together around said cavities to form closed capsules, the surfaces of said cavities forming the inner surfaces of said formed closed capsules.

3. The apparatus of claim 2 wherein said web feed means comprises first and second substantially cylindrical sealing rolls arranged in nipping relationship and mounted to rotate in opposite directions, each of said sealing rolls directing one of said webs toward the nip of said sealing rolls; and wherein said sealing means comprises the nip of said sealing rolls.

4. The apparatus of claim 3 further including cavity forming means associated with said first and second sealing rolls for forming said series of cavities in predetermined positions in said webs prior to said webs being passed through the nip of said first and second sealing rolls.

5. The apparatus of claim 2 wherein said evacuation member comprises a wedge member disposed between said first and second sealing rolls and said evacuation surface comprises a first concave surface of complementary shape to the surface of said first sealing roll and a second concave surface of said wedge member of complementary shape to the surface of said second sealing roll, said first and second concave surfaces converging towards one another adjacent the nip between said first and second sealing rolls, said recessed portion and edge sealing means of said evacuation surface comprising a recess and surrounding edge portion in each of said first and second concave surfaces of said wedge member for sealing against said webs as said webs are moved toward said nip by said first and second sealing rolls, and wherein said first and second flow communication means each communicate with said recess of each of said first and second concave surfaces, said first flow communication means being operative for withdrawing air entrapped between the surfaces of said webs facing away from said first and second sealing rolls and said first and second concave surfaces, and said second flow communication means being operative for introducing an inert gas between said surfaces of said webs facing away from said first and second sealing rolls and said first and second concave surfaces so that air is evacuated from said cavities in said webs and inert gas is introduced into said cavities.

6. The apparatus of claim 5 wherein said depositing means comprises a fluid communication passage in said wedge for injecting a fluid into said cavities prior to said sealing rolls sealing said webs together, said fluid communication means communicating with said cavities in said webs adjacent the nip between said first and second sealing rolls.

7. The apparatus of claim 6 further including solid depositing means for depositing a solid material into said cavities prior to said cavities being brought into juxtaposition and sealed by the nip of said sealing rolls.

8. The apparatus of claim 5 wherein said depositing means comprises means for depositing a solid material into said cavities prior to said cavities being brought into juxtaposition and sealed by the nip of said sealing rolls.

9. A method of making capsules comprising the steps of:

feeding capsule forming material having a series of cavities formed therein along a predetermined path, said capsule forming material forming a portion of the casing of the capsules;

depositing a material to be encapsulated into said cavities of said capsule forming material as said capsule forming material is moved along said path;

disposing an evacuation member having an evacuation surface relative to said capsule forming material so that said evacuation surface faces said cavities in said capsule forming material, said evacuation surface having a recessed portion and edge sealing means there-around for sealing against said capsule forming material as said capsule forming material is moved past said evacuation member to form a substantially airtight seal between said evacuation member and said capsule forming material;

connecting a source of vacuum with a first portion of said recessed portion of said evacuation surface to withdraw air entrapped between the surface of said capsule forming material and said evacuation surface as said capsule forming material is moved along said predetermined path, and connecting a source of inert gas with a second portion of said recessed portion of said evacuation surface to introduce an inert gas into said cavities between said surface of said capsule forming material and said evacuation surface as said capsule forming material is moved along said predetermined path, said first and second portions being spaced from one another along said evacuation surface so as to provide a continuous sweeping of air from said cavities and replacement thereof with an inert gas as said capsule forming material is moved past said evacuation member; and then sealing said cavities in said capsule forming material to form substantially deaerated capsules.

10. The method of claim 9 in which said capsule forming material comprises a pair of webs having a series of cavities therein; wherein said step of feeding comprises feeding said webs along converging paths so that said cavities in one of said webs are brought into juxtaposition with said cavities in the other of said webs; and wherein said step of sealing comprises sealing said webs around said juxtaposed cavities to form said capsules.

11. The method of claim 10 wherein said step of feeding said webs comprises feeding said webs about first and second sealing rolls arranged in nipping relationship and mounted to rotate in opposite directions, each of said sealing rolls directing one of said webs toward the nip of said sealing webs; and wherein said step of sealing comprises passing said webs through the nip of said first and second sealing rolls.

12. The method of claim 11 wherein said step of feeding said webs about said first and second sealing rolls comprise feeding undeformed sheets of capsule forming material onto said first and second sealing rolls and then forming said cavities in said sheets as said sealing rolls move said sheets toward the nip of said sealing rolls.

13. The method of claim 11 wherein said step of disposing an evacuation member comprises disposing a wedge member between said first and second sealing rolls, said evacuation surface of said wedge member comprising first and second concave surfaces of complementary shape to the surfaces of said first and second sealing rolls respectively, said first and second concave surface of said wedge member converging towards one another adjacent the nip between said first and second sealing rolls, and said recessed portion and edge sealing means comprising a recess and surrounding edge portion in each of said first and second concave surfaces for sealing against said webs as said webs move toward said nip of said first and second sealing rolls; and wherein said source of vacuum is connected with a first portion of each of said recesses of said first and second concave surfaces to withdraw air entrapped between the surfaces of said webs facing away from said first and second sealing rolls and said first and second concave surfaces and said source of inert gas is connected with a second portion of each of said recesses of said first and second concave surfaces to introduce an inert gas between said surfaces of said webs facing away from said first and second sealing rolls and said first and second concave surfaces so that air is evacuated from said cavities in said webs and an inert gas is introduced into said cavities.

14. The method of claim 11 wherein the step of depositing a material comprises injecting a fluid into said cavities prior to said webs being brought into the nip of said sealing rolls.

15. The method of claim 11 wherein said step of depositing comprise depositing a solid material into said cavities prior to said cavities in said webs being brought into juxtaposition and sealed in the nip of said sealing roll.

16. The method of claim 11 wherein said step of depositing comprises depositing a solid material into said cavities and injecting a liquid material into said cavities prior to said webs being brought into the nip of said sealing rolls.

* * * * *